US007536974B2

(12) United States Patent
Iwasaki et al.

(10) Patent No.: US 7,536,974 B2
(45) Date of Patent: May 26, 2009

(54) LIQUID APPLYING APPARATUS AND PRINTING APPARATUS

(75) Inventors: Osamu Iwasaki, Suginami-ku (JP); Naoji Otsuka, Yokohama (JP); Yoshinori Nakagawa, Kawasaki (JP); Atsuhiko Masuyama, Shinagawa-ku (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 601 days.

(21) Appl. No.: 11/445,030

(22) Filed: Jun. 1, 2006

(65) Prior Publication Data

US 2006/0279618 A1 Dec. 14, 2006

(30) Foreign Application Priority Data

Jun. 8, 2005 (JP) ..... 2005-168568

(51) Int. Cl.
*B05C 11/00* (2006.01)
*B05C 1/08* (2006.01)
*B41J 2/01* (2006.01)

(52) U.S. Cl. ..... 118/46; 118/262; 347/103

(58) Field of Classification Search ..... 347/101, 347/103; 118/46, 262, 263; 101/424.2; 427/428.15; 428/428.17

See application file for complete search history.

(56) References Cited

U.S. PATENT DOCUMENTS

| | | | | |
|---|---|---|---|---|
| 3,952,700 | A * | 4/1976 | Little et al. | 399/102 |
| 5,993,524 | A * | 11/1999 | Nagai et al. | 106/31.27 |
| 6,183,079 | B1 * | 2/2001 | Meade et al. | 347/101 |
| 6,960,259 | B2 * | 11/2005 | Takekoshi et al. | 118/217 |

FOREIGN PATENT DOCUMENTS

| | | | |
|---|---|---|---|
| JP | 08-58069 | A | 3/1996 |
| JP | 08-72227 | A | 3/1996 |
| JP | 2001-70858 | A | 3/2001 |
| JP | 2002-96452 | A | 4/2002 |
| WO | WO 99/64243 | | 12/1999 |

* cited by examiner

*Primary Examiner*—Anh T. N. Vo
(74) *Attorney, Agent, or Firm*—Canon USA Inc IP Div

(57) ABSTRACT

A liquid holding member abuts against an applying surface (outer surface) of an applying member which applies an applying liquid to an applying medium, and a liquid holding space for holding the applying liquid is formed between the applying member and the liquid holding member. By rotating the applying member, the applying liquid held in the liquid holding space is affixed to the outer surface of the applying member while being restricted to the abutting member, and the applying liquid is applied to the medium. In this event, the abutting position of the applying member and the liquid holding member differs between after applying operation completion and before applying operation starting. Thus, distortion generated at the abutting position of the applying surface of the applying member and the liquid holding member can be reduced.

8 Claims, 20 Drawing Sheets

LIQUID APPLYING APPARATUS AND PRINTING APPARATUS

BACKGROUND OF THE INVENTION

1. Field of the Invention

The present invention relates to a liquid applying apparatus and an ink jet printing apparatus, and particularly to a liquid applying apparatus that applies a liquid to a medium for a predetermined purpose, for example, for starting the coagulation of pigments earlier when printing is carried out using inks composed of the pigments as color materials. Likewise, the present invention relates to an ink jet printing apparatus including a mechanism that applies the liquid to a print medium used for ink jet printing, for a purpose, for example, for starting the coagulation of pigments earlier when printing is carried out using inks composed of the pigments as color materials.

2. Description of the Related Art

A spin coater, a roll coater, a bar coater, and a die coater are known as systems for applying a liquid or an aqueous material to various media. These applying systems are premised on continuous application on relatively long applying media. Thus, for example, if liquid is applied to applying media having a relatively small size and intermittently conveyed, for each applying medium, paint beads may be disturbed at a position at which applying is started or ended. In this case, the coats obtained may be non-uniform among the applying media.

A known configuration that can solve this problem is described in Japanese Patent Laid-Open No. 2001-70858. On the basis of the die coater system, this configuration uses a rotating rod bar and ejects paint to the rod bar through an ejection slit to form a coat on the rod bar. The coat formed is contacted with and transferred to an applying medium as the rod bar rotates. In this case, if the coat formed on the rod bar is not transferred or applied to the applying medium, the paint is returned to a head by the rotation of the rod bar. The paint is then collected via a collecting slit. In other words, the rod bar continues to rotate even during non-applying, while the paint is being formed into a coat on the rod bar. This enables a uniform coat to be obtained even if applying media are intermittently supplied and being applied with the paint.

Even in the field of ink jet printing apparatuses, those using a liquid applying mechanism are known. Japanese Patent Laid-Open No. 2002-517341 describes an apparatus which uses a blade contacting with a roller and in which the coating liquid is collected between the blade and the roller so that the coating liquid is applied to the roller as the roller rotates. As the roller rotates, the coating liquid is transferred and applied to a support conveyed between this roller and another roller. Japanese Patent Laid-Open No. 08-72227 similarly discloses a mechanism in an ink jet printing apparatus which applies a treatment liquid before printing which insolubilizes dyes.

However, with the configurations described in the above patent documents, an application liquid is applied or supplied to the surface of the rod bar or roller, while the rod bar or roller rotates. However, the part of the rod bar or roller to which the application liquid is applied or supplied is open to or in communication with the air. Thus, disadvantageously, the application liquid may be evaporated or for example, the application liquid may leak when the posture of the apparatus is changed.

In particular, with an ink jet printing apparatus such as a printer, in view of, for example, the leakage of the liquid caused by a change in the posture of the apparatus during transportation thereof, it is difficult to apply the applying mechanism described in the above documents to the apparatus of which the size has been reduced.

In contrast, Japanese Patent Laid-Open No. 08-58069 discloses a configuration that seals a part that applies or supplies ink, that is, application liquids, to a roller. The applying mechanism described in this document operates in a gravure printing apparatus to apply ink to an applying roller having the surface of which is formed with a pattern of a printing plate. This mechanism uses an ink chamber (liquid holding member) having blades arranged at two vertical positions along a peripheral surface of the applying roller and extending in a longitudinal direction of the applying roller, and elastic members provided at both sides of the two blades. The chamber (liquid holding member) is contacted with the peripheral surface (applying surface) of the applying roller to form a liquid chamber between the ink chamber and the applying roller. Then, the applying roller is rotated to apply or supply the application liquid from the liquid chamber to the applying roller.

However, in the event of applying the technology disclosed in Japanese Patent Laid-Open No. 08-58069 to an apparatus for applying an applying liquid uniformly to an applying medium through an applying roller, the transferring capability of the applying liquid to the applying medium and the sealing capability are insufficient. In other words, with Japanese Patent Laid-Open No. 08-58069 which discloses gravure printing technology, a convex-concave pattern is formed on the surface of the applying roller, and the transfer amount of the applying liquid to the applying medium is not uniform, so that transferring capability cannot be sufficient. Also, the convex-concave pattern formed on the surface of the applying roller results in insufficient sealing by the contacting of the applying roller and the liquid holding member (ink chamber). Further, the material of the applying roller surface being metallic also is a cause of insufficient sealing.

The results of study by the present inventor indicate that in order to have both transferring capability of the applying liquid to the applying medium and sealing capability, the surface of the applying roller is desirable to be configured with an elastic member, and further is desirable to have as soft a material as possible. Further, the desirable hardness of the elastic member for the surface of the applying roller is less than a rubber hardness of 40 degrees.

Therefore, the surface of the applying roller was configured with an elastic member and further investigation was continued. Then the following new problem occurred. First, an apparatus was prepared having an applying member such as an applying roller having an applying surface made of an elastic surface and a liquid holding member that abuts against the applying surface to form a liquid holding space to hold the liquid, and this apparatus was stopped for a long period of time. That is to say, the apparatus was allowed to stand for a long period of time without changing the contact position of the applying surface and the liquid holding space. Then pressure was formed on the contacting part of the liquid holding member on the applying surface, and the applying surface of the parts thereof was distorted. Whatever type of rubber material is used, this distortion is not removed instantaneously even when the pressure is released. If the apparatus is stopped for a long period of time and is subsequently started an applying operation, the applying surface having the concave portion generated in the contact part applies the applying liquid to the medium. The concave part of the applying surface generates a state of the applying surface and the applying medium not contacting, or a state wherein contact between the applying surface and the applying medium is small. Thus, the applying liquid may not be applied on portions of the applying medium, or insufficient applying liquid is applied.

SUMMARY OF THE INVENTION

The present invention is directed to a liquid applying apparatus which can reduce distortion generated at a contact position between an applying surface of an applying member and a liquid holding member, a method of controlling the liquid applying apparatus, and a printing apparatus.

According to an aspect of the present invention, a liquid applying apparatus includes a liquid applying unit. The liquid applying unit includes an applying member having an applying surface with variable elasticity and adapted to apply a liquid to a medium, and a liquid holding member that abuts against the applying surface of the applying member to define a liquid holding space to hold the liquid. The liquid applying unit applies the liquid held in the liquid holding space to the medium through the applying surface by rotating the applying surface of the applying member. The apparatus also includes an abutting position setting unit configured to set an abutting position after a completed applying operation according to an abutting position before starting the applying operation, so that the abutting position of the applying member and the liquid holding member after the completed applying operation differs from the abutting position thereof before starting the applying operation.

According to another aspect of the present invention, a control method of the liquid applying apparatus includes preparing an applying member having an applying surface with variable elasticity and adapted to apply a liquid to a medium and a liquid holding member that abuts against the applying surface of the applying member to define a liquid holding space to hold the liquid; applying the liquid held in the liquid holding space to the medium through the applying surface by rotating the applying surface of the applying member; and causing an abutting position of the applying member and the liquid holding member after completing the applying the liquid to differ from the abutting position of the applying member and the liquid holding member before starting the applying the liquid.

According to yet another aspect of the present invention, a printing apparatus for printing on a printing medium includes a conveying unit configured to convey the printing medium along a predetermined conveying path; a liquid applying unit including an applying member having an applying surface with variable elasticity and adapted to apply a liquid, and a liquid holding member that abuts against the applying surface of the applying member to define a liquid holding space to hold the liquid, wherein the liquid applying unit applies the liquid to the printing medium, which is conveyed along the conveying path, through the applying surface by rotating the applying surface of the applying member; a printing unit configured to print to the printing medium on which the liquid is applied by the liquid applying unit; and an abutting position setting unit configured to set an abutting position after a completed applying operation according to an abutting position before starting the applying operation, so that the abutting position of the applying member and the liquid holding member after the completed applying operation differs from the abutting position thereof before starting the applying operation.

According to a yet still another aspect of the present invention, a printing apparatus for printing on a printing medium using ink including a color material and a liquid for coagulating the color material in the ink, includes a liquid applying unit, which includes an applying member having an applying surface with variable elasticity and adapted to apply the liquid to the printing medium and a liquid holding member that abuts against the applying surface of the applying member to form a liquid holding space to hold the liquid, for applying the liquid to the printing medium through the applying surface by rotating the applying surface of the applying member; an ink jet head for discharging ink to the printing medium on which the liquid is applied by the liquid applying unit; and an abutting position changing unit configured to cause the abutting position of the applying member and the liquid holding member after the completed applying operation to differ from the abutting position thereof before starting the applying operation.

According to the present invention, the frequency that the contacting part of the applying surface and the liquid holding member are stopped at the same position when the applying member is stopped can be reduced, and so distortion generated when the liquid holding member and the applying surface are contacting when the applying member is stopped can be decreased.

Further features of the present invention will become apparent from the following description of exemplary embodiments with reference to the attached drawings.

DESCRIPTION OF THE EMBODIMENTS

First Embodiment

The embodiments of the present invention will be described in detail below with reference to the attached drawings.

Figure 1:
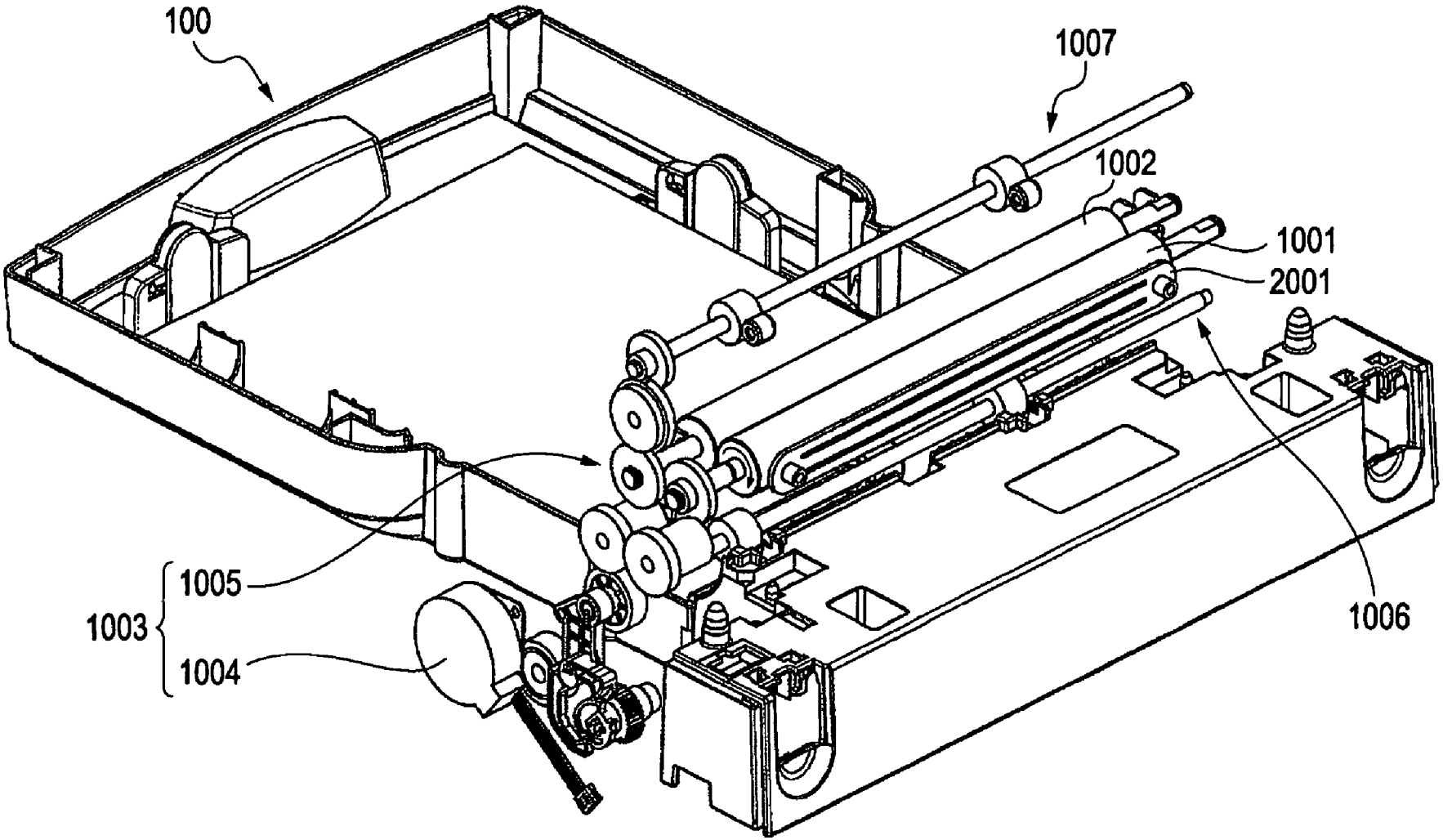
FIG. 1 is a perspective view generally showing the configuration of a liquid applying apparatus in accordance with an embodiment of the present invention.

FIG. 1 is a perspective view showing the entire configuration of an embodiment according to a liquid applying apparatus 100 of the present invention. The liquid applying apparatus 100 shown here roughly has a liquid applying unit for applying a predetermined application liquid to an applying medium, and a liquid supplying unit for supplying the application liquid to the liquid applying unit.

The liquid applying unit has a cylindrical applying roller 1001, a cylindrical counter roller (medium supporting member) 1002 positioned opposite to the applying roller 1001, a roller driving mechanism 1003 that drives the applying roller 1001, and so forth. The roller driving mechanism 1003 includes a roller driving motor 1004 and a transmission mechanism 1005 which transmits the driving force of the roller driving motor 1004 to the applying roller 1001 and which has a gear train and the like.

The liquid supplying unit has, for example, a liquid holding member 2001 that holds the application liquid between the liquid holding member 2001 and a peripheral surface of the applying roller 1001, and a liquid channel 3000 (not shown in FIG. 1) described below for supplying the liquid to the liquid holding member 2001. The applying roller 1001 and the counter roller 1002 are rotatively supported by respective shafts which are parallel to each other, each of which has ends rotatively attached to a frame (not shown). Further, the liquid holding member 2001 extends almost all along the applying roller 1001 in a longitudinal direction and is movably attached to the frame via a mechanism that enables the liquid holding member 2001 to contact with and separate from the peripheral surface of the applying roller 1001.

The liquid applying apparatus 100 according to the present embodiment further includes an applying medium supplying mechanism 1006 which consists of a pickup roller or the like to convey an applying medium to a nip portion between the applying roller 1001 and the counter roller 1002. Further, in a conveying path for applying media, a sheet discharging mechanism 1007 consisting of a sheet discharging roller or the like is provided downstream of the applying roller 1001 and the counter roller 1002 to convey an applying medium on which the application liquid has been applied, to a sheet discharging section (not shown). Similar to the applying roller and the like, the sheet supplying mechanism and the sheet discharging mechanism operate under the driving force of the driving motor 1004 transmitted via the transmission mechanism 1005.

The application liquid used in the present embodiment is intended to facilitate the coagulation of pigments when printing has been carried out using inks including the pigments as color materials. An example of the components of the application liquid is shown below.

Tetrahydrate of calcium nitrate: 10%

Glycerin: 42%

Surface active agent: 1%

Water: remaining amount

The application liquid can have a viscosity of about 5 to 6 cP (centipoise) at 25° C.

In applications of the present invention, of course, the application liquid is not limited to the one described above. For example, a liquid including a component which insolubilizes or coagulates a dye may be used as another application liquid.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension.

Figure 2:
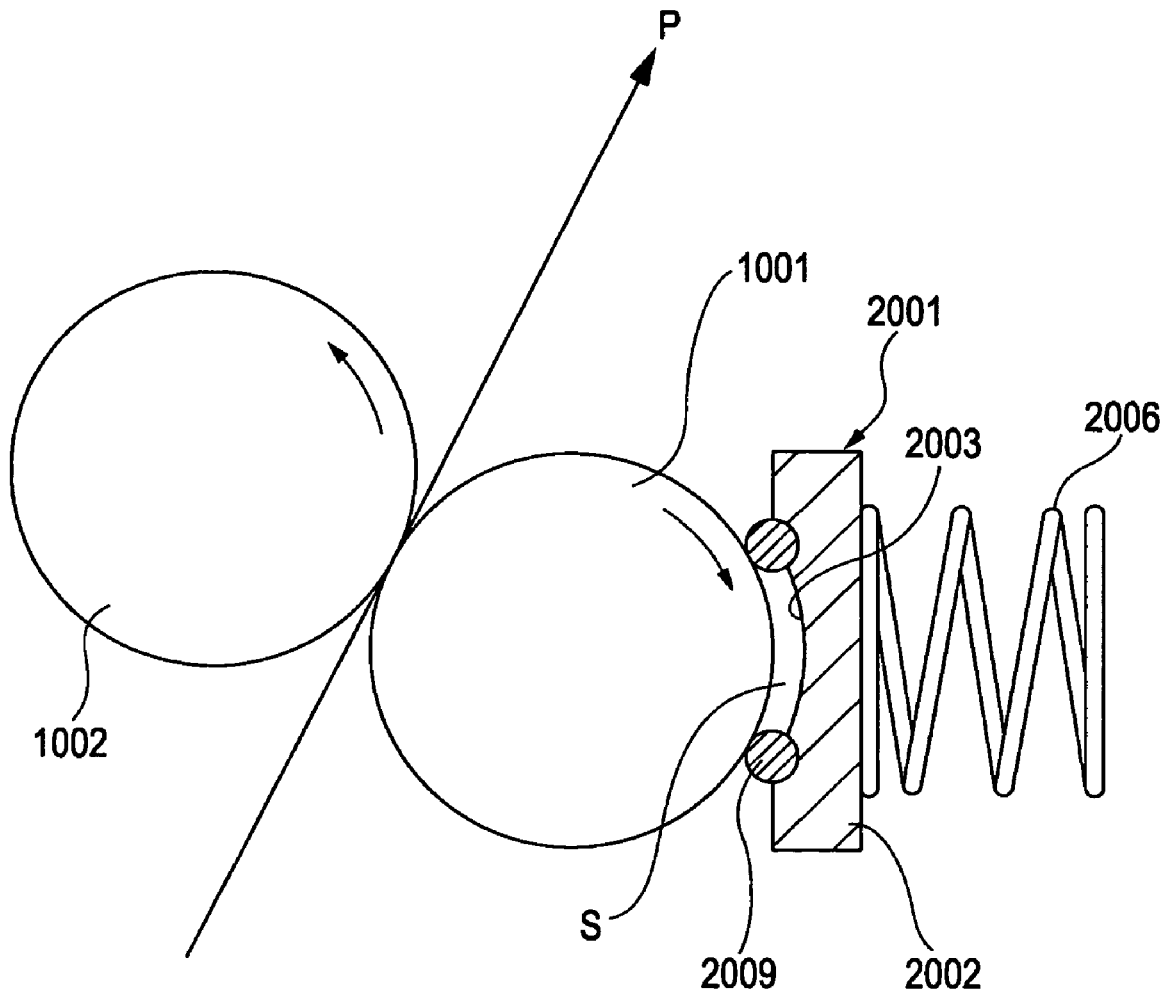
FIG. 2 is a vertical side view showing an example of the arrangement of an applying roller, a counter roller, and a liquid holding member which are shown in FIG. 1.

Now, a detailed description will be given of the elements of the sections of the liquid applying apparatus described above. FIG. 2 is a vertical sectional view illustrating an example arrangement of the applying roller 1001, the counter roller 1002, and the liquid holding member 2001.

The counter roller 1002 is biased by a biasing unit (not shown) toward the peripheral surface of the applying roller 1001. By rotating the applying roller 1001 clockwise in the figure, it is possible to sandwich an applying medium P on which the application liquid is to be applied, between both rollers, while conveying the applying medium P in the direction of an arrow in the figure.

The surface material of the applying roller 1001 is configured with an elastic member, such as a rubber which can have a rubber hardness of 40 degrees or less. Thus, the transferring capability of the application liquid to the applying medium and the sealing capability with the abutting member 2009 described below can be achieved. The measurement method of the rubber hardness is as specified in "JIS K 6253 Type A". With the present embodiment, the surface material of the applying roller 1001 can be an EPDM (ethylene-propylene-diene rubber) with a rubber hardness of 30 degrees, surface roughness of about Ra 1.6 μm, and diameter of about 22.19 mm. The material of the counter roller 1002 can be aluminum, with the surface processed to be mirror-like and the diameter of about 22.19 mm.

Further, when pressed and abutted against the peripheral surface of the applying roller 1001 under the biasing force of a spring member (pressing unit) 2006, the liquid holding member 2001 forms an elongated liquid holding space S extending all over an area liquid-applied by the applying roller 1001. The application liquid from a liquid supplying channel 3000, described below, is supplied to the interior of the liquid holding space S via the liquid holding member 2001. In this case, since the liquid holding member 2001 is configured as described below, the application liquid can be prevented from inadvertently leaking from the liquid holding space S to the exterior while the applying roller 1001 is stopped.

Figure 3:
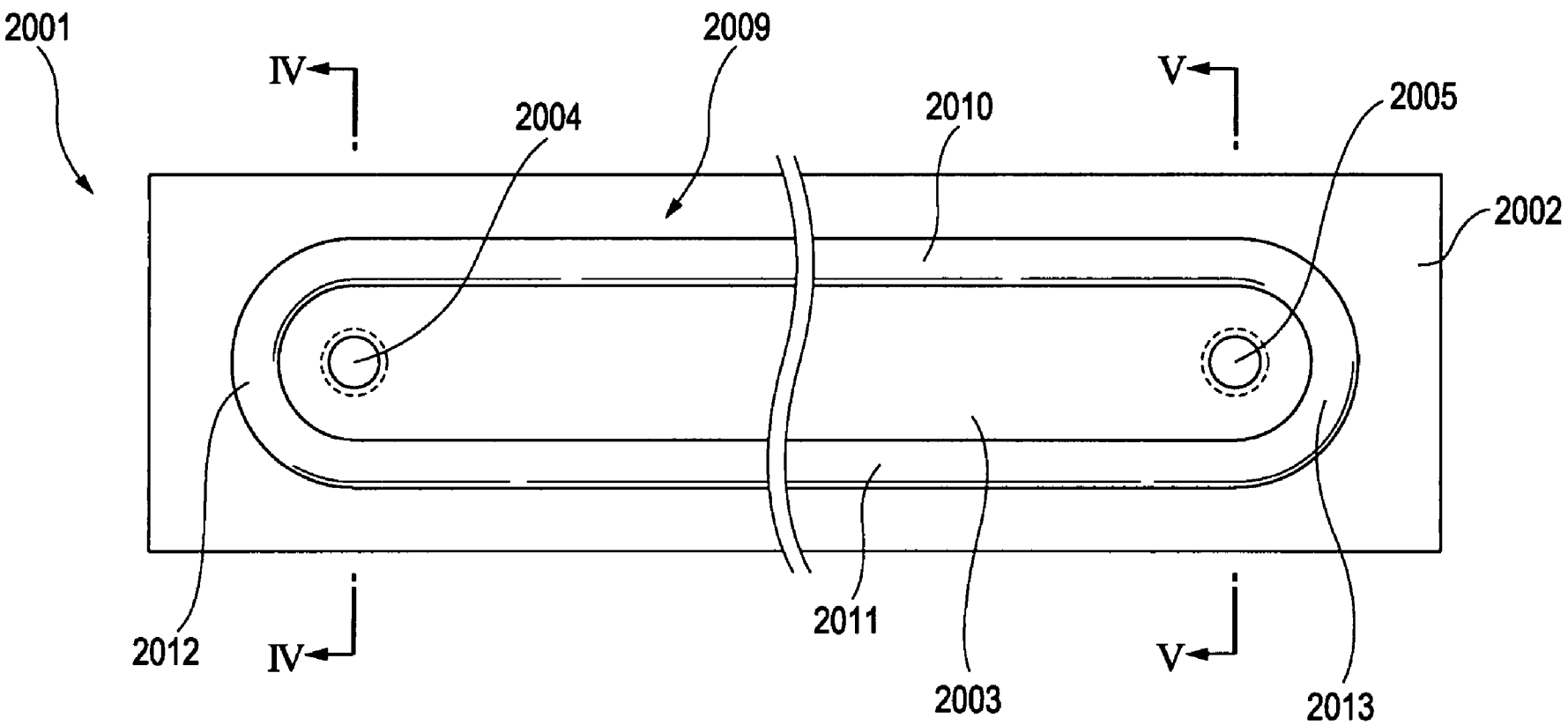
FIG. 3 is a front view of the liquid holding member shown in FIGS. 1 and 2.

FIGS. 3 through 8 show the configuration of the liquid holding member 2001. As shown in FIG. 3, the liquid holding member 2001 has a space forming base material 2002 and an annular abutting member 2009 located on one surface of the space forming base material 2002. A concave portion 2003 is formed in a central portion of the space forming base material 2002 along its longitudinal direction. The abutting member 2009 has two linear portions (upper edge 2010 and lower edge 2011) fastened along the upper edges of the concave portion 2003. Also, the circular portions (right edge 2013 and left edge 2012) on the right and left sides of the abutting member are fastened so as to extend from one linear edge of the concave portion 2003 through the bottom portions on the left and right to the linear portion (lower edge 2011) on the opposite side of the concave portion 2003. Thus, when the abutting member 2009 of the liquid holding member 2001 abuts against the applying roller 1001, it is possible to achieve the abutment along the peripheral surface of the applying roller, and to achieve the abutment at a uniform pressure.

With the present embodiment, the material for the abutting member 2009 can be NBR (nitrile-butadiene rubber), the hardness can be about 70 degrees, and the diameter can be about 3.5 mm.

As described above, in the liquid holding member according to this embodiment, the abutting member 2009, formed integrally and seamlessly, is continuously abutted without a gap against the outer peripheral surface of the applying roller 1001 under the biasing force of the spring member 2006. As a result, the liquid holding space S is a space substantially closed by the abutting member 2009, one surface of the space forming base material, and the outer peripheral surface of the applying roller 1001, and the liquid is held in this space. Then, when the rotation of the applying roller 1001 is stopped, the abutting member 2009 and the outer peripheral surface of the applying roller 1001 maintain a liquid tight state, and the liquid can be reliably prevented from leaking to the exterior. On the other hand, when the applying roller 1001 is rotated, the application liquid can slipperily flow between the outer peripheral surface of the applying roller 1001 and the abutting member 2009 as described below and is affixed in a layer form on the outer peripheral surface of the applying roller. In this case, when the applying roller 1001 is stopped and the liquid tight state is established between the outer peripheral surface and the abutting member 2009, the liquid cannot flow out of the space between the above-described interior and exterior of the liquid holding space S. In this case, the abutting state of the abutting member 2009 includes not only direct abutment against the outer peripheral surface of the applying roller 1001 but also abutment against the outer peripheral surface via a liquid film formed under a capillary force.

Figure 4:
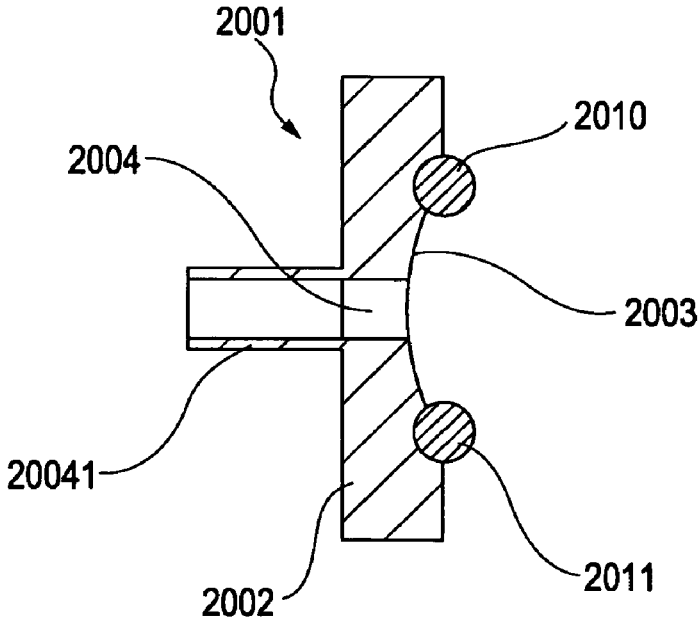
FIG. 4 is an end view showing an end surface of the liquid holding member shown in FIG. 3, taken along line A-A in FIG. 3.
Figure 5:
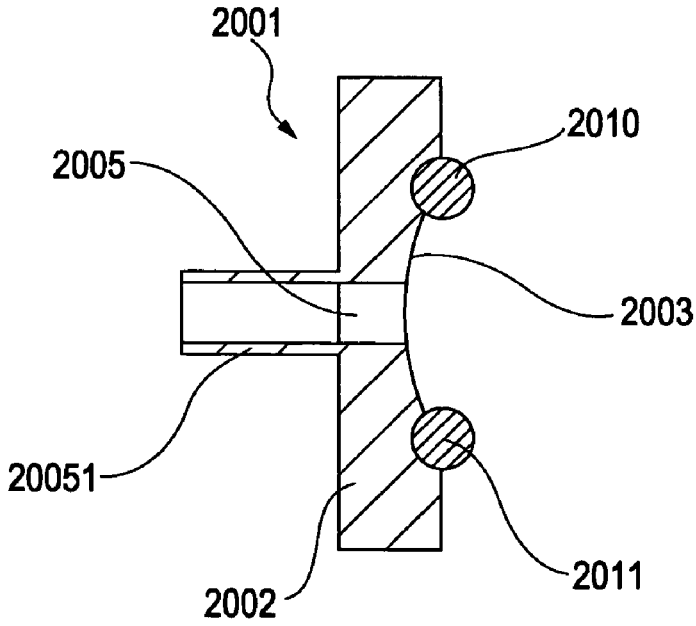
FIG. 5 is an end view showing the end surface of the liquid holding member shown in FIG. 3, taken along line B-B in FIG. 3.
Figure 6:
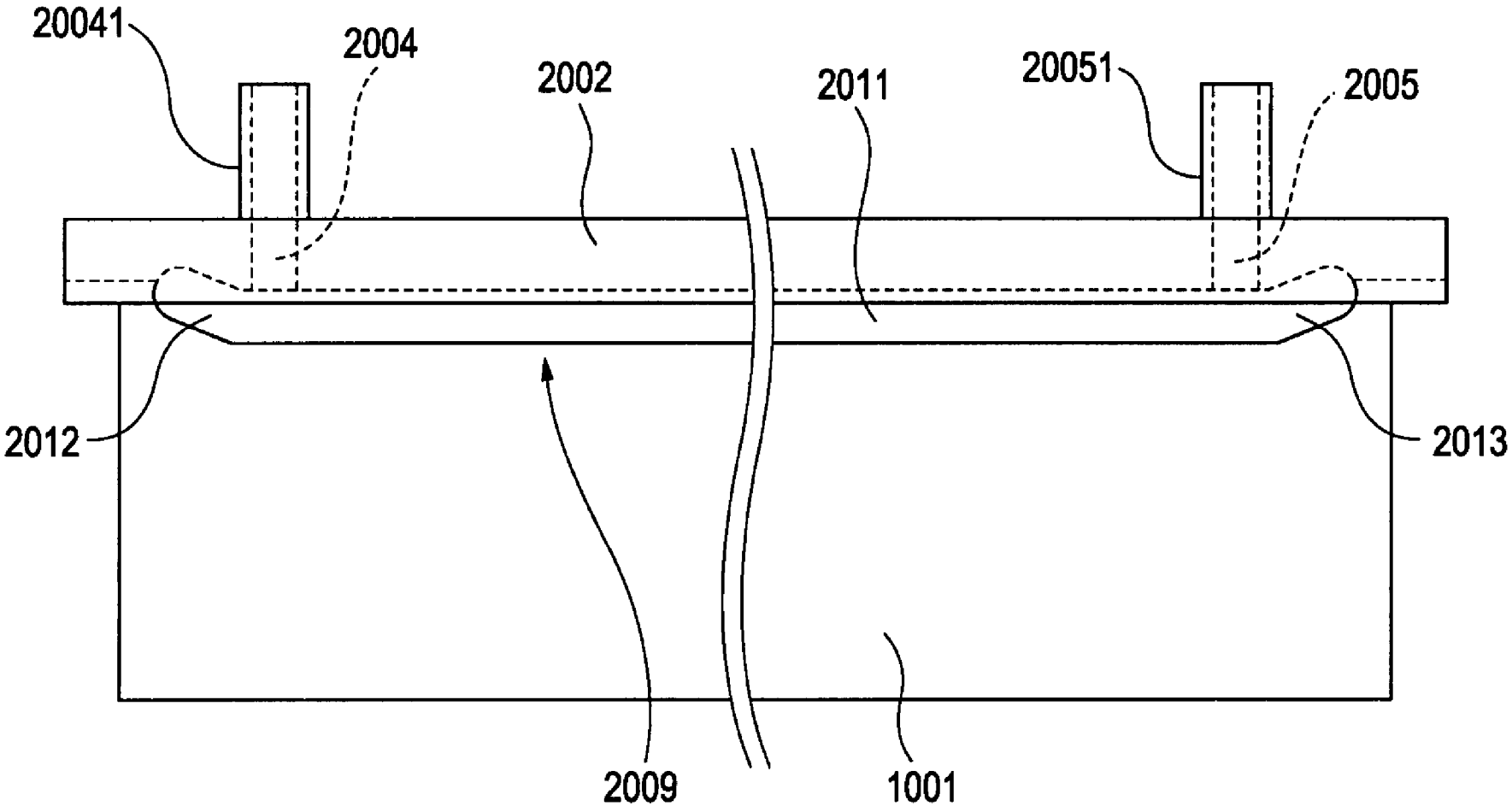
FIG. 6 is a plan view of the liquid holding member shown in FIG. 3.
Figure 7:
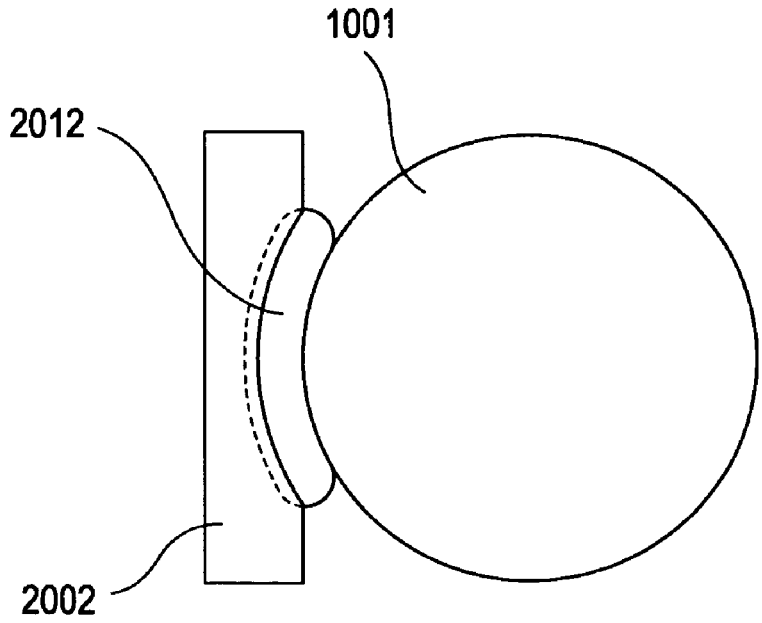
FIG. 7 is a left side view showing how an abutting portion of the liquid holding member shown in FIG. 3 is abutted against a liquid applying roller.
Figure 8:
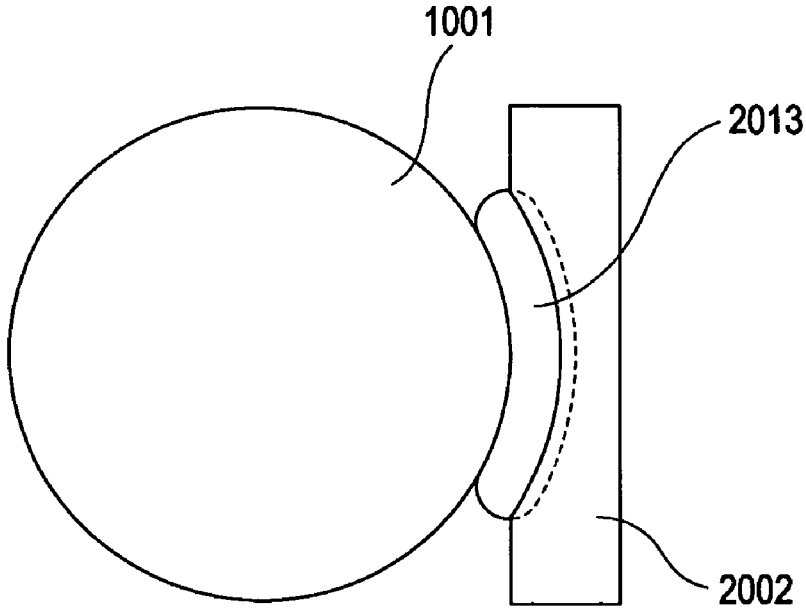
FIG. 8 is a right side view showing how an abutting portion of the liquid holding member shown in FIG. 3 is abutted against the liquid applying roller.

As shown in FIGS. 3 through 8, both longitudinally left and right sides of the abutting member 2009 are gently curved as viewed from its front (FIG. 6), from above (FIG. 3), or from its side (FIGS. 7 and 8). Thus, even when the abutting member 2009 is abutted against the applying roller 1001 under relatively high pressure, the whole abutting member 2009 is substantially uniformly elastically deformed, and thus large distortions are not generated locally. Thus, as shown in FIGS. 6 through 8, the abutting member 2009 abuts tightly without a gap against the outer peripheral surface of the applying roller 1001, and a substantially closed space can be formed as described above.

On the other hand, as shown in FIGS. 3 through 5, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 communicate with cylindrical connecting portions 20041 and 20051 projected from a back surface of the space forming base material. Further, the connecting portions 20041 and 20051 are connected to a liquid channel 3000 described below. In this embodiment, the liquid supplying port 2004 is formed near one end of an area surrounded by the abutting member 2009 (the left end in FIG. 3), while the liquid collecting port 2005 is formed near the other end of the same area (the right end in FIG. 3). The liquid supplying port 2004 is used to supply the application liquid provided through the liquid channel 3000, to the liquid holding space S. The liquid collecting port 2005 is used to allow the liquid in the liquid holding space S to flow out to the liquid channel 3000. The supply and flowout of the application liquid allows the liquid to flow from the left end to the right end of the liquid holding space S.

Application Liquid Channel

Figure 11:
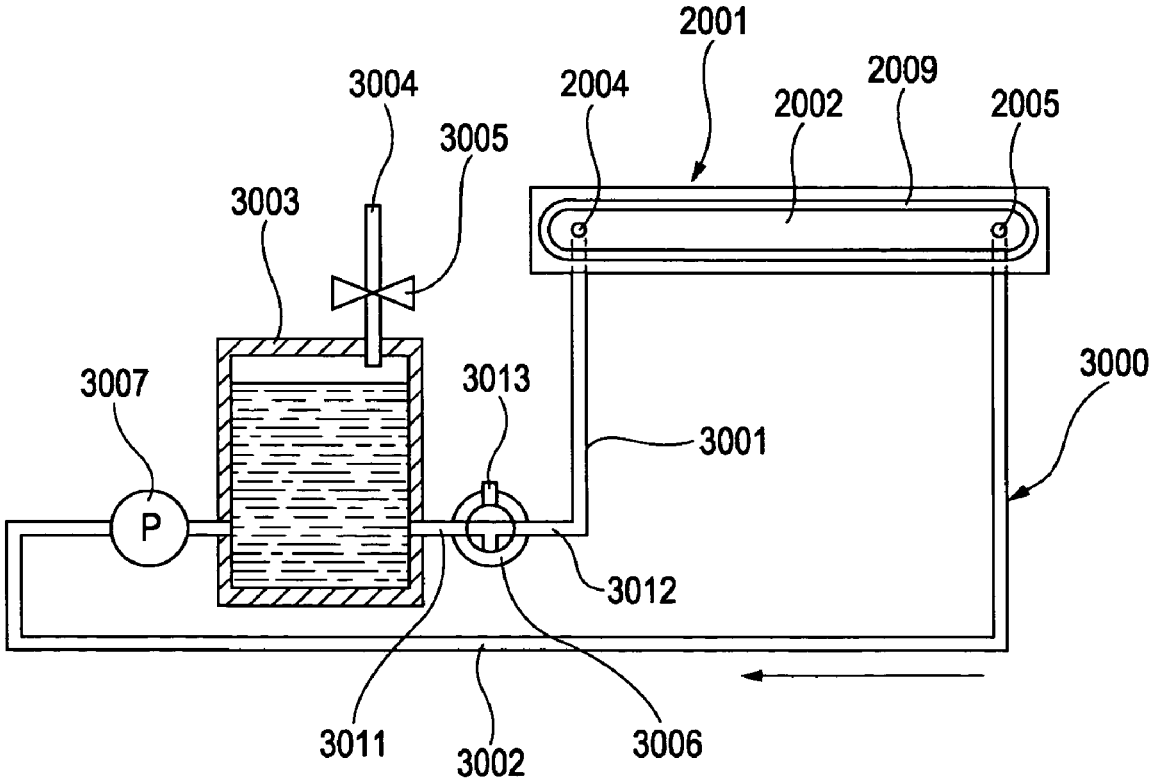
FIG. 11 is a diagram generally showing the configuration of a liquid channel in the liquid applying apparatus according to the embodiment of the present invention.

FIG. 11 is an explanatory diagram showing the overall configuration of a liquid channel 3000 which is connected to the liquid holding member 2001 of an application liquid supplying unit.

The liquid channel 3000 has a first channel (supply path) 3001 which connects the liquid supplying port 2004 of the space forming base material 2002, which configures the liquid holding member 2001, and the storage tank 3003, which stores the application liquid. The liquid channel 3000 also has a second channel (collecting path) 3002 which connects the liquid collecting port 2005 of the space forming base material 2002 and storage tank 3003. An air communicating port 3004 is provided on the storage tank 3003. Also, an air communicating valve 3005 for switching between enabling and disabling communication with the air is provided on the air communicating port. Also, a selector valve 3006 is provided in the first channel 3001 for enabling or disabling communication of the first channel 3001 so that the air can be switched. Further, in the second channel 3002, a pump 3007 is connected to force the flow of application liquid or air in the desired direction within the liquid channel 3000. With the present embodiment, the pump 3007 generates flow of the liquid in the direction from the first channel 3001 to the second channel 3002 (the direction shown with an arrow in the diagram).

With the present embodiment, the first channel 3001 and the second channel 3002 are formed with cylindrical tubes. The opening portions formed on the end portion of each tube is arranged in a position on the bottom of the storage tank 3003 or close to the bottom thereof, and is arranged so that the application liquid within the storage tank 3003 is completely consumed.

The selector valve 3006 according to the present embodiment can be various types that selectively enable and disable communication between the first channel 3001 and the air, but here a three-way valve is used, as shown in FIG. 11. This three-way valve 3006 has three ports that are in communication with one another. It is possible to allow two of the three ports to selectively communicate with any two of the storage tank tube 3011, the liquid holding member tube 3012, and the air communicating port 3013 in the first channel 3001. The three-way valve 3006 allows the selective switching between a connected state in which the tubes 3011 and 3012 are in communication, and a connected state in which the tube 3012 and the air communicating port 3013 are in communication. This enables the application liquid in the storage tank 3003 or the air obtained through the air communicating port 3013 to be selectively supplied to the space S formed by the liquid holding member 2001 and the applying roller 1001. The switching of the three-way valve 3006 is carried out in accordance with a control signal from a control section 4000 described below, and thus the application liquid is filled or supplied.

Control System

Figure 12:
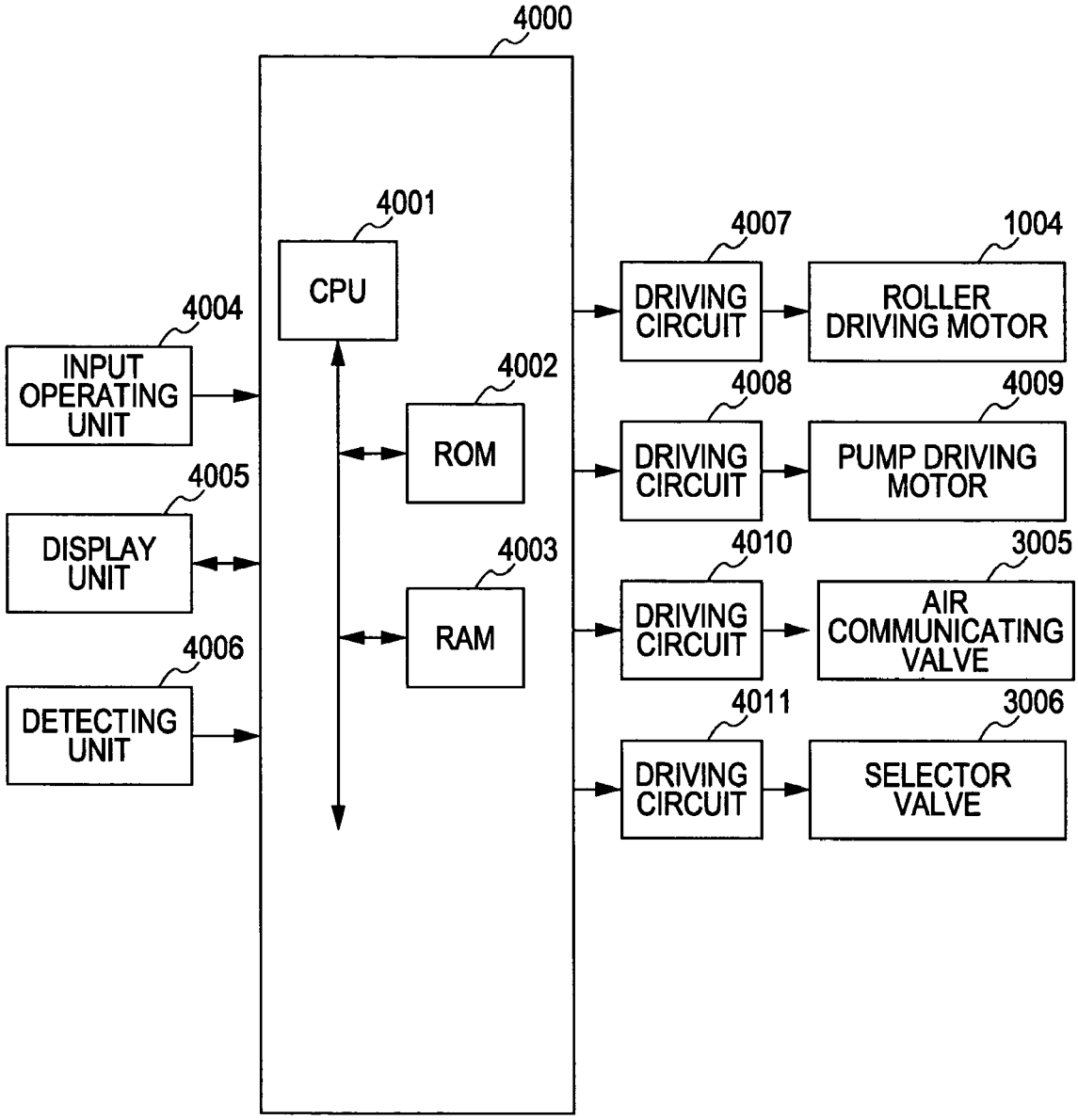
FIG. 12 is a block diagram showing the overall configuration of a control system according to the embodiment of the present invention.

FIG. 12 is a block diagram generally showing the configuration of a control system in the liquid applying apparatus according to the present embodiment. In FIG. 12, a control section 4000 controls the whole liquid applying apparatus. The control section 4000 has a CPU 4001 that performs various process operations such as calculations, control, and determinations; a ROM 4002 that stores, for example, control programs for processes executed by the CPU 4001, such as the one described below in FIG. 13; and a RAM 4003 that temporarily stores data used during process operations of the CPU 4001 as well as input data. Information showing the abutting position of the applying member and the liquid holding member when the applying operation is stopped is also stored in the RAM 4003.

The control section 4000 is connected to an input operation section 4004 including a keyboard, various switches, or the like with which predetermined instructions or data are input; a display unit 4005 that provides various displays including inputs to and the set state of the liquid applying apparatus; and a detecting unit 4006 including a sensor or the like which detects the position of an applying medium or the operational state of each section. The control section 4000 is also connected to the roller driving motor 1004, a pump driving motor 4009, an air communicating valve 3005, and the selector valve 3006, via driving circuits 4007, 4008, 4010, and 4011.

Liquid Applying Operation Sequence

Figure 13:
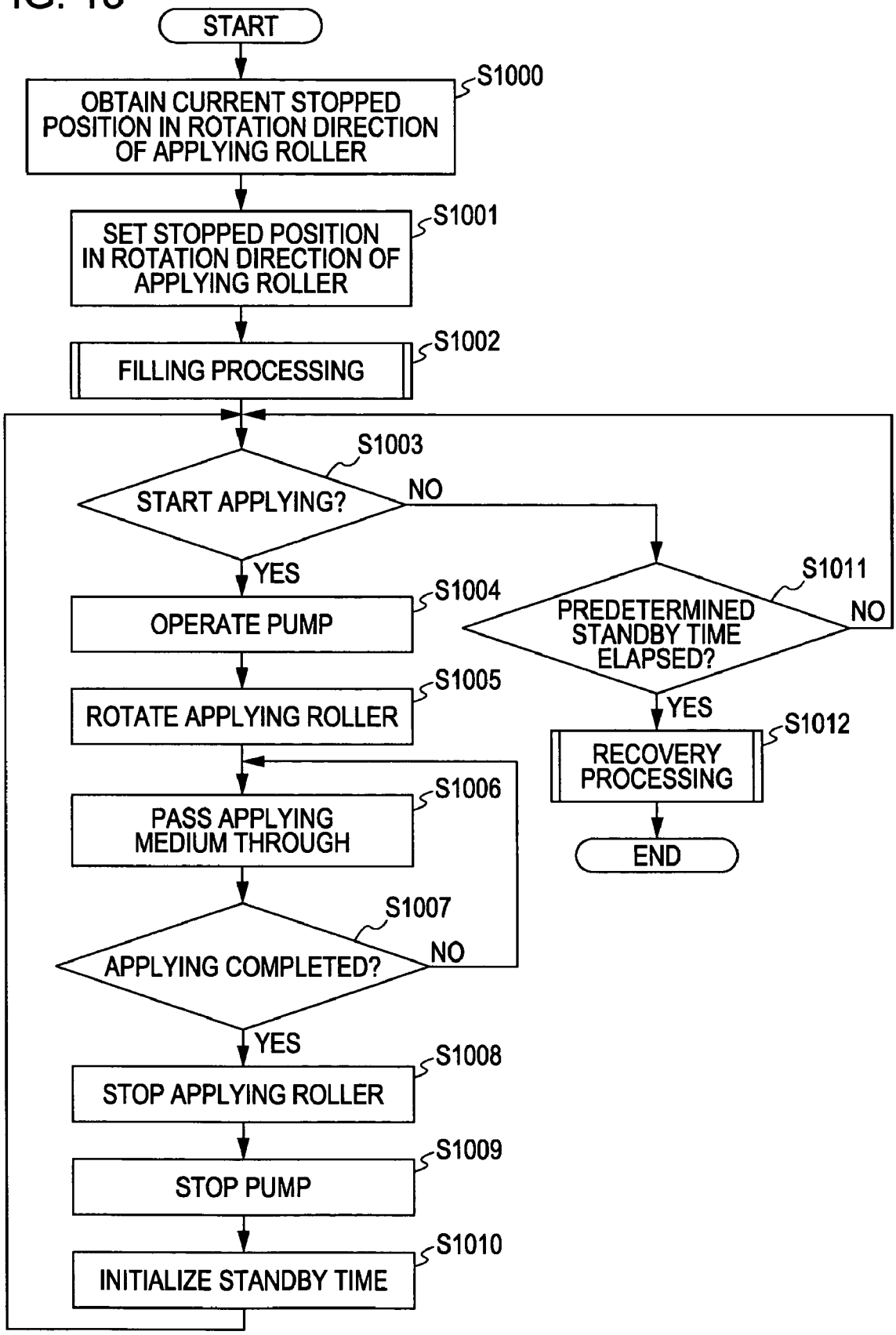
FIG. 13 is a flowchart showing a liquid operation sequence according to a first embodiment of the present invention.

FIG. 13 is a flowchart showing a process procedure for applying a liquid in the liquid applying apparatus according to the present embodiment. The steps of liquid application will be described below with reference to this flowchart. When the liquid applying apparatus receives an applying start preparation instruction, the control section 4000 executes an applying operation sequence described below, in accordance with the flowchart shown in FIG. 13.

Setting the Applying Roller Stopping Position

In Step S1000, prior to the rotation operation of the applying roller 1001 described later, the current stopping position in the rotation direction of the applying roller 1001, in other words, the information showing the abutting position of the applying member and the liquid holding member is acquired. Thus, the position of the liquid holding member 2001 abutting against the abutting member 2009 in the rotation direction can be found in the applying surface of the applying roller 1001. At this time, in the case that the applying roller 1001 is managed at an absolute rotation position, the information showing the managed absolute rotation position is acquired, and in the case of being in a state of an absolute rotation position not being managed such as that immediately following the power being turned on, the information showing the initialized rotation position (for example, 0 in the case of zero resetting) is acquired. The information showing such an abutting position can be acquired by reading from the RAM 4003.

Next, in Step S1001, the stopping position is set for the rotation direction of the applying roller 1001. Certain positions are not desirable for position to stop the applying roller. Such positions are, for example, positions such as those shown in FIGS. 15, 16, and 17.

Figure 15:
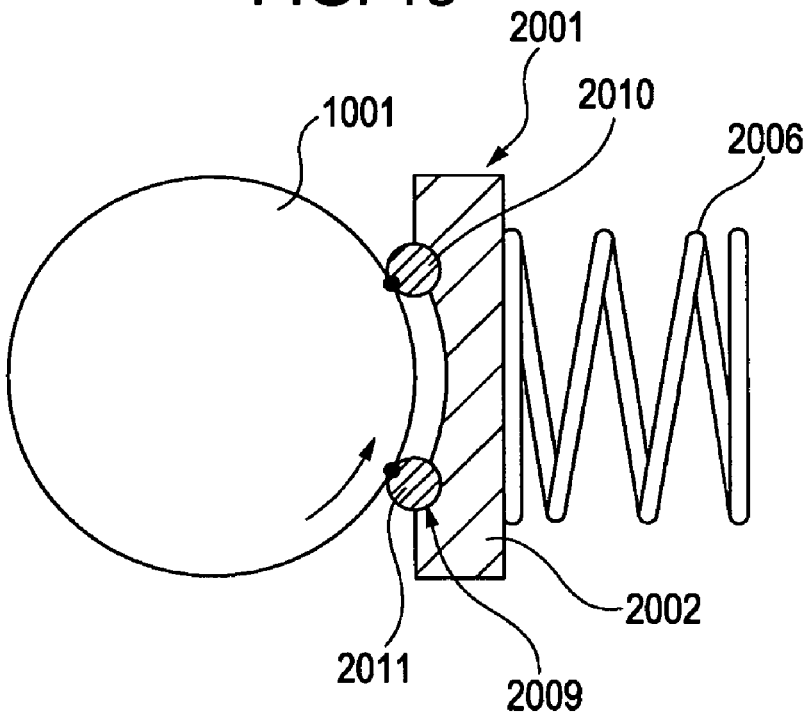
FIG. 15 is a diagram describing the relationship between a previous stopped position of the nip and a current stopped position of the nip, according to the first embodiment of the present invention.
Figure 16:
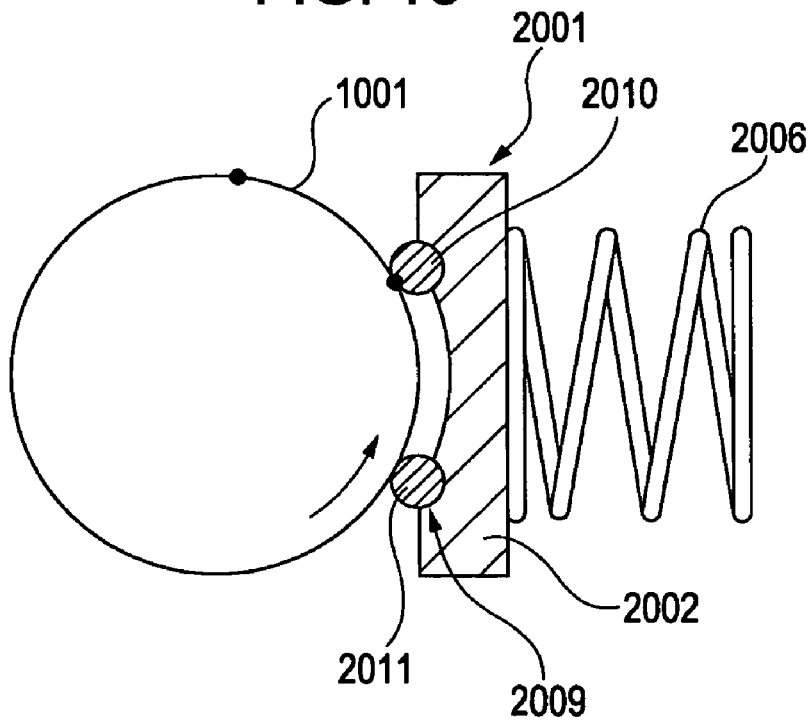
FIG. 16 is a diagram describing the relationship between a previous stopped position of the nip and a current stopped position of the nip, according to the first embodiment of the present invention.
Figure 17:
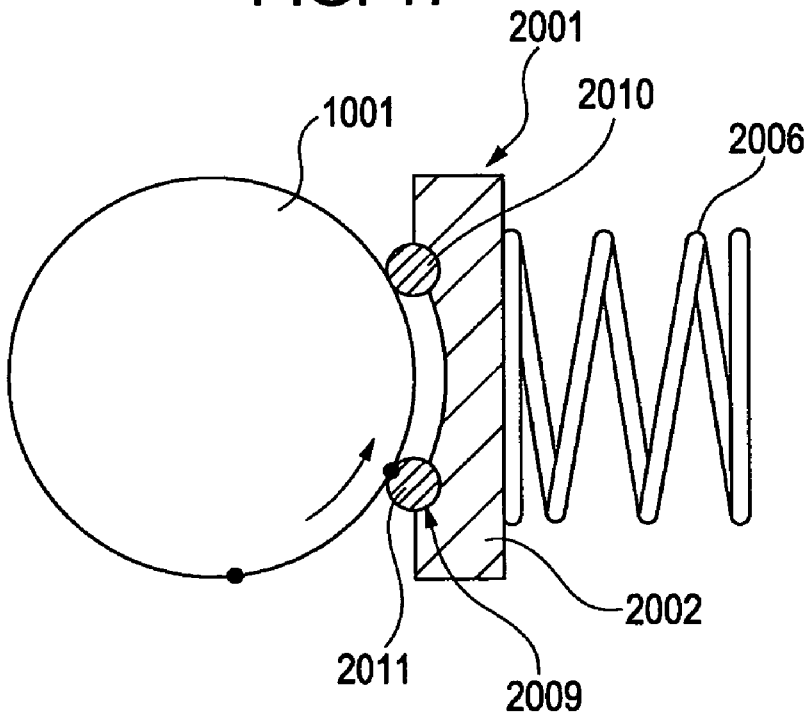
FIG. 17 is a diagram describing the relationship between a previous stopped position of the nip and a current stopped position of the nip, according to the first embodiment of the present invention.

In FIGS. 15 through 17, the black dots on the applying surface of the applying roller 1001 show the nip positions at which, until this point in time, the upper edge 2010 and the lower edge 2011 of the abutting member 2009 have been abutting. In other words, the black dots show the positions on the applying roller 1001 (previous abutting position) on which the upper edge 2010 and the lower edge 2011 of the abutting member 2009 have been abutting, in the event that the initialized position is acquired. Here, the position in the rotation direction of the application surface shown in FIG. 15 is not desirable because the same position as the previous abutting position abuts against the abutting member 2009. The position in the rotation direction of the application surface shown in FIG. 16 is not desirable because the abutting position which during the previous abutting had abutted against the lower edge 2011 of the abutting member 2009 abuts against the upper edge 2010 of the abutting member 2009. Similarly, the position in the rotation direction of the application surface shown in FIG. 17 is not desirable because the abutting position, which during the previous abutting had abutted against the upper member 2010 of the abutting member 2009, abuts against the lower edge 2011 of the abutting member 2009. In other words, if the abutting position at the prior stopped time abuts continuously against the abutting member 2009 during the next stopped time, the concave portion (distortion) formed on the application surface by the abutting member 2009 is unable to recover completely by the elasticity of the abutting member 2009 and is pressed again. Thus, distortions are accumulated.

Thus, with the first embodiment, the stopping position on the applying surface after the completed applying operation is set to a position that is varied only a predetermined amount along the rotation direction from the prior stopped position which is acquired in Step S1001. Thus, the frequency of relative positions as shown in FIGS. 15 through 17 is decreased, and the accumulation of distortion on the applying surface of the applying roller can be reduced. In this case, the abutting position is controlled not only for the setting during the current stopping time to differ from the abutting position during the prior stopping time, but also for the setting to differ from N stopping times (N is an integral of 2 or greater) prior to the prior stopping time for each abutting position. In other words, the stopping position is set after the completed application operation so that until the abutting position (for example, position 1) of the applying surface against which the abutting member 2009 has abutted one time abuts against the abutting member 2009 a second time, multiple abutting positions (for example, position 2, position 3, position 4, and so forth) which differ from the above-mentioned position A should be present as stopping positions after the completed applying operation. This is so that, while the applying operation and the stopping operation are repeated, the distortion formed on the applying surface can be recovered by the elasticity of the applying roller 1001 and the sliding of the abutting member 2009.

Accordingly, the spacing of displacement (hereafter called the amount of displacement) of the stopping position after the completed applying operation from the prior stopping position in the rotation direction must be set so as not to be the same as or one half of the setting spacing in the rotation direction of the upper edge 2010 and lower edge 2011. If the amount of displacement is set to be the same spacing from the upper edge 2010 to the lower edge 2011, when the applying surface is moved in the same rotation direction as the applying operation (the direction shown with an arrow in the figure), the stopping position thereof has the relative position shown in FIG. 16. Also, if rotated in the reverse direction, the relative position is that shown in FIG. 17. Further, if the amount of displacement is set to one half, a similar state occurs after displacement is repeated twice after the completed applying operation. Also, the amount of displacement can be set as less than one half of the spacing between the upper edge 2010 and the lower edge 2011. This is because the abutting position of the applying surface which had been abutting against the upper edge 2010 or the lower edge 2011 at the prior stopping time will abut against the upper edge 2010 or the lower edge 2011 again after a small number of repetitions of the applying operation and stopping operation. Also, setting the displacement to multiples such as one half, one third, one fourth, two thirds, three fourths, and the like of the peripheral length of the applying roller should also be avoided.

Figure 18:
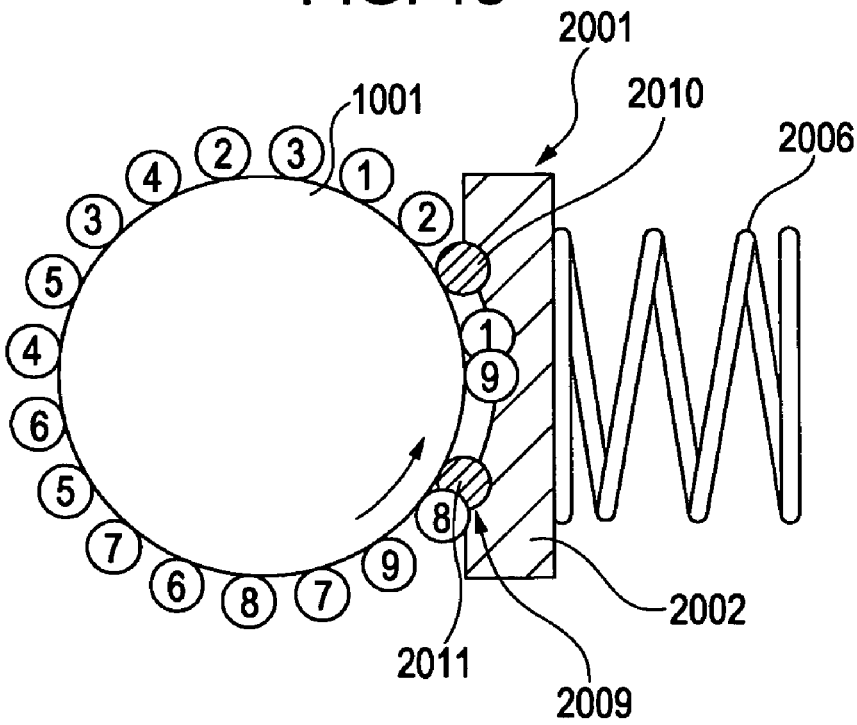
FIG. 18 is a diagram describing the relationship between a previous stopped position of the nip and a current stopped position of the nip, according to the first embodiment of the present invention.

A value for the amount of displacement, for example, can be set as two thirds of the spacing from the upper edge 2010 to the lower edge 2011 of the abutting member 2009. The abutting position of the applying surface of the applying roller 1001 and the abutting member 2009 in this case is shown in FIG. 18. The circled numbers shown on the peripheral of the applying roller 1001 in FIG. 18 show the number of stopping times prior to that the applying roller had abutted against the abutting member 2009. In the case of the present embodiment, the abutting position of the tenth prior stopping time is generally the same position of the abutting position at the current stopping time. In other words, if ten stoppings are not performed, the applying roller will not stop at an abutting position with history of stopping, and the concave portion (distortion) formed on the applying surface can recover sufficiently during that time.

Thus with Step S1001, the abutting position after the completed applying operation is set based on the abutting position before starting the applying operation, so that the abutting position of the applying surface and the liquid holding member after the completed applying operation differs from the abutting position before starting the applying operation. The information showing the abutting position to be set is stored in the RAM 4003, and is used for setting the abutting position for the next applying operation.

Filling Step

Returning to FIG. 13, in step S1002, the liquid holding space S is filled with the application liquid, as a pre-treatment. In this filling step, the air communicating valve 3005 of the storage tank 3003 is first opened to the air, the selector valve (three-way valve) 3006 is switched to communicate the tubes 3011 and 3012, and the pump 3007 is driven for a specified time. Accordingly, if the liquid holding space S and the channels 3001 and 3002 have not been filled with the application liquid, the pump 3007 drives the air inside the space and channels out to the storage tank. The air is then discharged to the exterior of the apparatus. These portions are then filled with the application liquid. On the other hand, if these portions have already been filled with the application liquid, the application liquid in these portions starts to flow. These portions are thus supplied with an application liquid having an appropriate concentration and viscosity. This initial operation allows the application liquid to be supplied to the applying roller 1001. It is thus possible to apply the application liquid to an applying medium.

Applying Step

Then, an applying start instruction is inputted (step S1003). Then, the pump 3007 restarts operation (step S1004). The applying roller 1001 starts rotating clockwise as shown by an arrow in FIG. 1 (step S1005). The rotation of the applying roller 1001 causes the application liquid L filled into the liquid holding space S to slipperily flow between the applying roller 1001 and the lower edge 2011 of the abutting member 2009 against the pushing force of the abutting member 2009 of the liquid holding member 2001, which force acts on the applying roller 1001. The application liquid adheres to the outer periphery of the applying roller 1001 in layer form. The application liquid L adhering to the applying roller 1001 is transferred to the abutting portion between the applying roller 1001 and the counter roller 1002.

Figure 9:
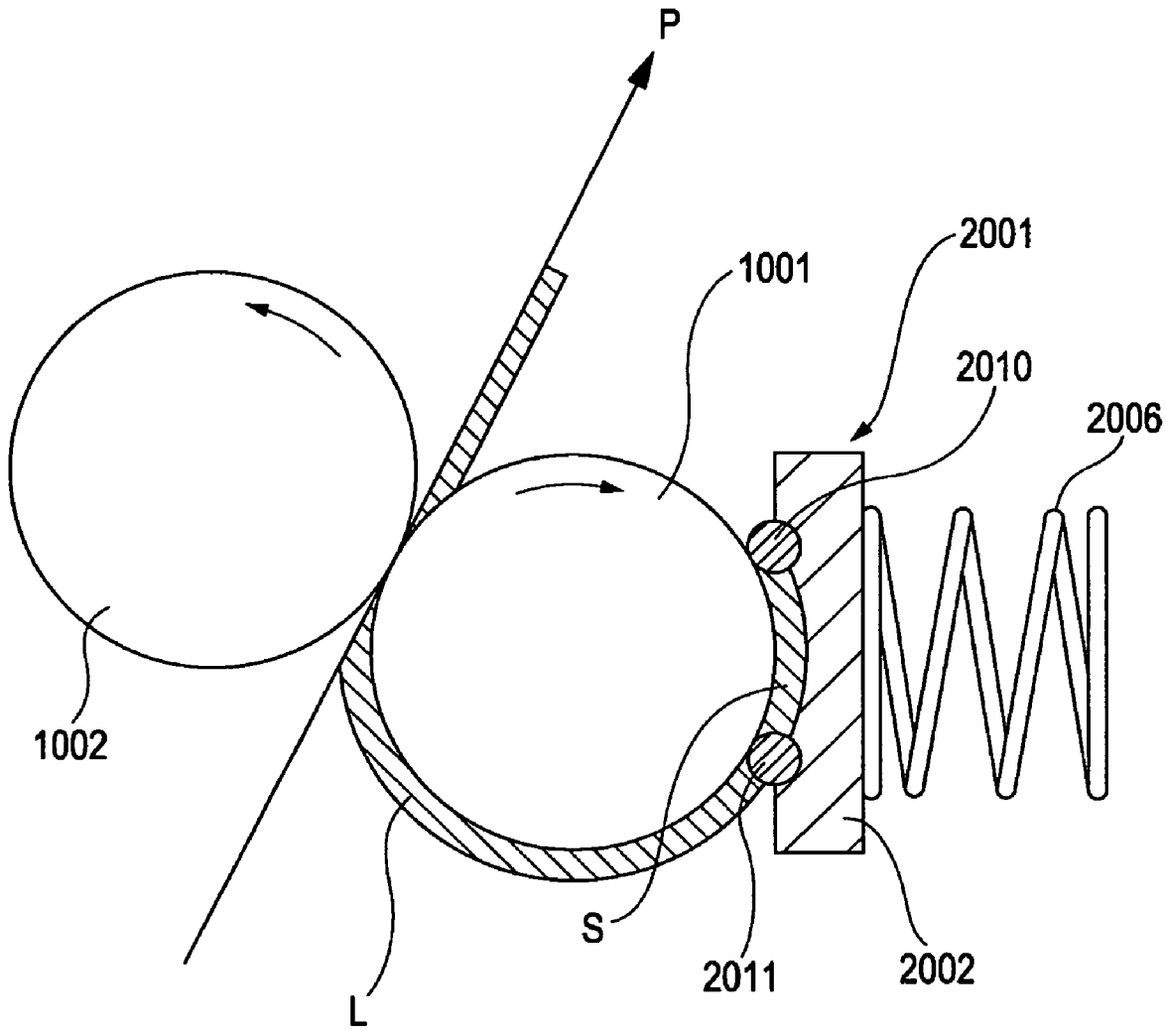
FIG. 9 is a vertical sectional view showing how an application liquid is filled into a liquid holding space formed by the liquid holding member and the applying roller and how a liquid is applied to an applying medium by the rotation of the applying roller, according to an embodiment of the present invention.

Then, an applying medium supplying mechanism 1006 conveys an applying medium to a point between the applying roller 1001 and the counter roller 1002. The applying medium is inserted between these rollers and conveyed to a sheet discharging section as the applying roller 1001 and the counter roller 1002 rotate (step S1006). During this conveyance, the application liquid applied to the peripheral surface of the applying roller 1001 is transferred from the applying roller 1001 to the applying medium P as shown in FIG. 9. Of course, the mechanism for supplying an applying medium to between the applying roller 1001 and the counter roller 1002 is not limited to the above supplying mechanism. It is possible to use any mechanism, for example, a manual mechanism which uses a predetermined guide member in conjunction or independently.

In FIG. 9, an area with crossing oblique lines denotes the application liquid L. In this case, the layer thickness of the application liquid on the applying roller 1001 and applying medium P is shown considerably thicker than the actual one in order to clearly illustrate how the application liquid L is applied.

As described above, an applied part of the applying medium P is conveyed in the direction of the arrow under the conveying force of the applying roller 1001. Further, an unapplied part of the applying medium P is conveyed to the contact portion between the applying medium P and the applying roller 1001. This operation is continuously or intermittently performed to apply the application liquid to the entire applying medium.

FIG. 9 shows the ideal applied state in which all of the application liquid L adhering to the applying roller 1001 after slipperily flowing out of the abutting member 2009 is transferred to the applying medium P. However, actually, not all of the application liquid L adhering to the applying roller 1001 is transferred to the applying medium P. Specifically, when the applying medium P conveyed separates from the applying roller 1001, the application liquid L often remains on the applying roller 1001. The amount of application liquid L remaining on the applying roller 1001 varies depending on the material of the applying medium P or the state of fine concaves and convexes on the surface of the applying medium P. However, if the applying medium P is ordinary paper, the application liquid L remains on the peripheral surface of the applying roller 1001 after an applying operation.

Figure 14:
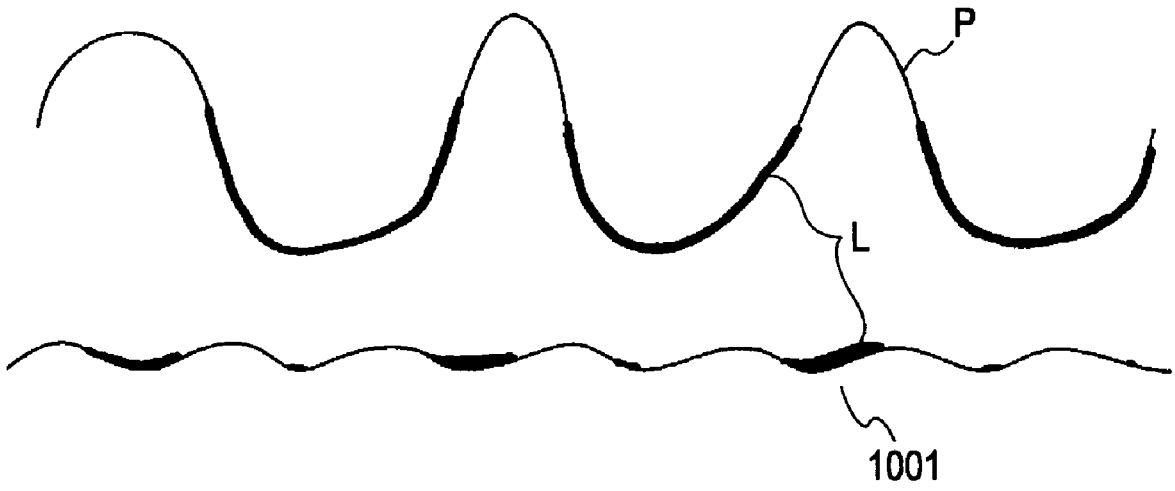
FIG. 14 is an explanatory diagram describing an applying process executed on a surface of a medium when such medium is an ordinary paper and an applying surface, on the downstream side from nip portions of the applying roller and the counter roller, according to an embodiment of the present invention.
Figure 24:
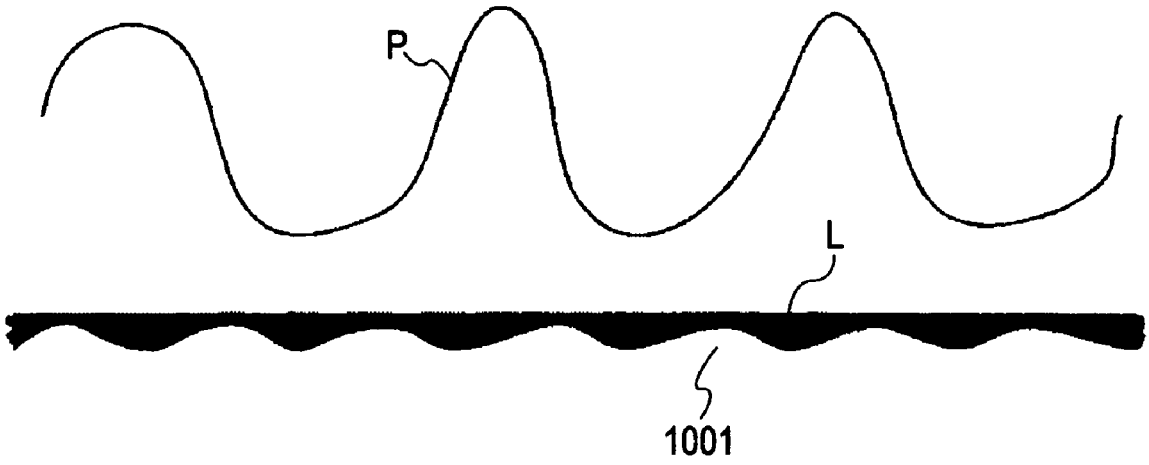
FIG. 24 is an explanatory diagram describing an applying process executed on a surface of a medium when such medium is an ordinary paper and an applying surface, on the upstream side from nip portions of the applying roller and the counter roller, according to an embodiment of the present invention.
Figure 25:
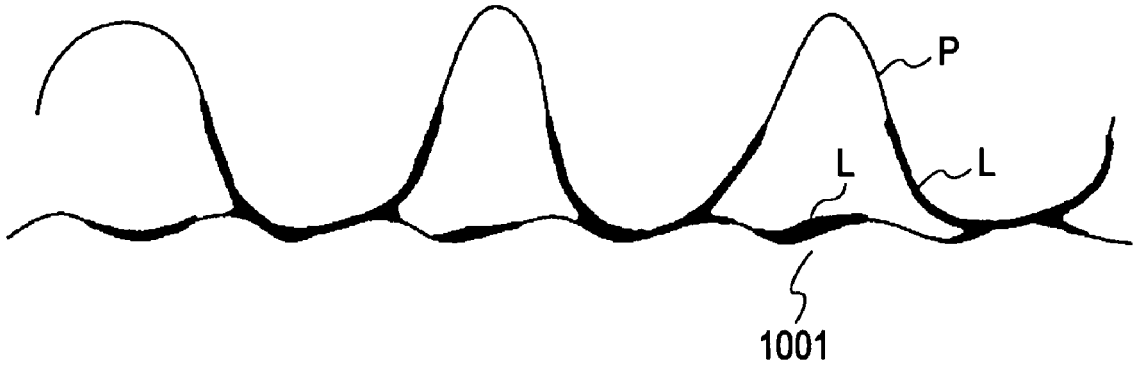
FIG. 25 is an explanatory diagram describing an applying process executed on a surface of a medium when such medium is an ordinary paper and an applying surface, and is showing the surface of a medium P as an ordinary paper and the applying surface of the applying roller at the nip portions of the applying roller and the counter roller, according to an embodiment of the present invention.

FIGS. 24, 25, and 14 are explanatory diagrams describing the process of applying between a surface of the medium P and an applying surface in the case where the medium is ordinary paper. In these figures, the liquid is painted over with black.

FIG. 24 shows the state of the upstream side of the nip portion between the applying roller 1001 and the counter roller 1002. In this figure, the liquid adheres to the applying surface of the applying roller 1001 so as to slightly cover the fine concaves and convexes on the applying surface.

FIG. 25 shows the state of the surface of ordinary paper serving as the medium P, and the applying surface of the applying roller 1001, at the nip portion between the applying roller 1001 and the counter roller 1002. In this figure, the convexes on the surface of the ordinary paper serving as the medium P, contact with the applying surface of the applying roller 1001. The liquid instantaneously permeates through or sticks to fibers in the surface of the ordinary paper serving as the medium P, through the contacting parts. The liquid adhering to those parts of the applying surface of the applying roller 1001 which do not contact with the convex portions on the surface of the ordinary paper remains on the applying surface.

FIG. 14 shows the state of the downstream side of the nip portion between the applying roller 1001 and the counter roller 1002. In this figure, the medium has completely left the applying surface of the applying roller 1001. The liquid adhering to those parts of the applying surface of the applying roller 1001 which do not contact with the convex portions on the surface of the ordinary paper remains on the applying surface. The liquid on the contacting parts also remains with very small amount on the coating surface.

The application liquid remaining on the applying roller 1001 slipperily flows between the applying roller 1001 and the upper edge 2010 of the abutting member 2009 and returns to the liquid holding space S, against the pushing force of the abutting member 2009 of the liquid holding member 2001, which force acts on the applying roller 1001. The application liquid is then mixed with the application liquid filled into the space S.

Figure 10:
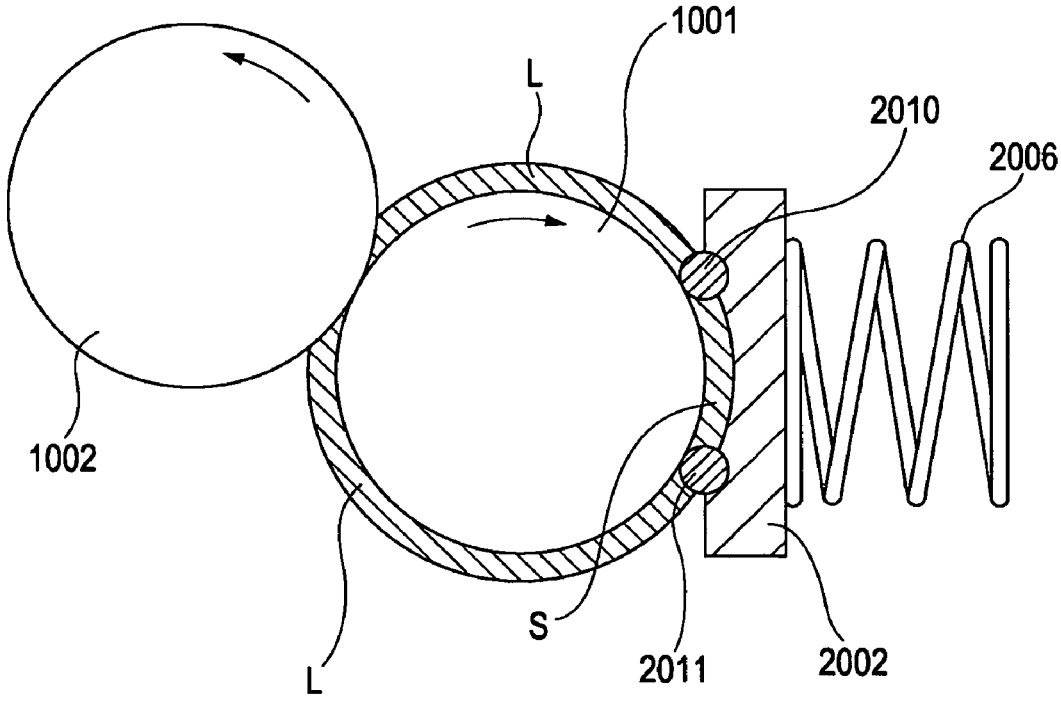
FIG. 10 is a vertical sectional view showing how an application liquid is filled into a liquid holding space formed by the liquid holding member and the applying roller and how the applying roller is rotated when no applying medium is present, according to the embodiment of the present invention.

Also, the operation of returning the application liquid is also performed if the applying roller 1001 is rotated when no applying medium is present as shown in FIG. 10. That is to say, the application liquid adhering to the outer periphery of the applying roller 1001 as a result of the rotation of the applying roller 1001 slipperily flows through the abutting portion (the nip portion) between the applying roller 1001 and the counter roller 1002. After flowing through the abutting portion, the application liquid is separated into two parts directed to the applying roller 1001 and the counter roller 1002, respectively. The application liquid remains on the applying roller 1001. Then, the application liquid L adhering to the applying roller 1001 side slipperily flows between the upper edge 2010 of the abutting portion 2009 and the applying roller 1001 to enter the liquid holding space S. The application liquid is then mixed with the application liquid filled into the space S.

Ending Step

Once the operation of applying the liquid to the applying medium has been performed as described above, the apparatus determines whether or not to finish the applying step (step S1007). If the applying step is not to be finished, the process returns to step S1006 to repeat the applying operation until the applying step is executed on all the parts of the applying medium to which the liquid needs to be applied. When the applying step is finished, the applying roller 1001 is stopped (step S1008). Moreover, the driving of the pump 3007 is stopped (step S1009). Also, the waiting time timer is reset to zero as the initial waiting time (step S1010). Also, the rotation stopping position of the applying roller 1001 in step S1008 is the stopping position set during step S1001. After this, the flow proceeds to step S1003, and if an applying start instruction is inputted, the operations in steps S1003 to S1010 are repeated. Further, if the applying start instruction is not input in step S1003, the flow proceeds to step S1011 in order to manage the waiting time, and whether or not a predetermined time which is measured by a waiting time timer has elapsed is determined. This predetermined time is appropriate to be set at approximately 60 seconds. If the predetermined time of the measured time has not elapsed in step S1011, the flow proceeds to step S1003, and the determinations in steps S1003 and S1010 are repeated until an applying start instruction is input. If the predetermined time is determined to have elapsed in step S1011, a post-process is executed such as a collecting operation of collecting the application liquid from the liquid holding space S and liquid channels (step S1012). Then, the coating process is finished.

This collecting operation is performed by opening the air communicating valve 3005 and the selector valve 3006 and driving the pump 3007 to cause the application liquid in the liquid holding space S and second channel 3002 to flow into the liquid storing tank 3003. Further, this collecting operation makes it possible to prevent the application liquid from being evaporated from the liquid holding space S. After the collecting operation, the air communicating valve 3005 is closed and the selector valve 3006 is switched to disable the communication between the first channel 3001 and the air communicating port 3013. The storage tank 3003 is thus shut off from the air. This prevents evaporation of the application liquid from the storage tank 3003. Since the storage tank 3003 is shut off from the air, the application liquid can be prevented from flowing out of the apparatus even if the posture of the apparatus is tilted during movement, transportation, or the like.

Thus, with the first embodiment, the stopping position of the applying roller after the completed applying operation is set to a position that is shifted only by the predetermined amount of displacement (for example, a position displaced approximately two-thirds of the spacing between the upper edge and the lower edge of the liquid holding member) from the stopped position of the applying roller before the completed applying operation in the rotation direction on the abutting member 2009 of the liquid holding member 2001. Then, with the ending step of the applying operation, the applying roller is stopped at the previously set stopping position. Thus, the abutting member 2009 of the liquid holding member 2001 and the applying surface of the applying roller 1001 are prevented from stopping continuously at the same position, and distortion being accumulated in the same position of the applying surface can be reduced.

Second Embodiment

Next, a second embodiment of the present invention will be described. With the first embodiment, the applying roller 1001 is prohibited from continuously stopping at the same position during a roller stopping period immediately before the applying operation and a roller stopping period immediately following the applying operation, and thus the distortion being accumulated in the same position of the applying surface can be prevented. However, even in this case, if starting and completing the applying operation are repeated in a short time period, the applying roller 1001 can stop on the position on which the applying roller has stopped for a long period or a position nearby, and distortion may accumulate on the applying surface.

Thus, with the second embodiment, nip cumulative time (abutting cumulative time) which is the cumulative value of the time that the applying roller 1001 has stopped at the same position on the abutting member 2009 of the liquid holding member 2001 (abutting time) is measured, and according to the measurement results thereof, the stopping position of the applying roller 1001 is set. The cumulative time measuring unit which measures the cumulative time is realized by the timer which is built into the CPU 5001 or the control system 4000.

Figure 19:
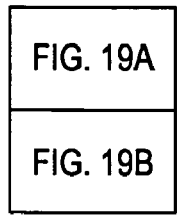
FIG. 19 is a flowchart showing a liquid operation sequence according to a second embodiment of the present invention.
Figure 19A:
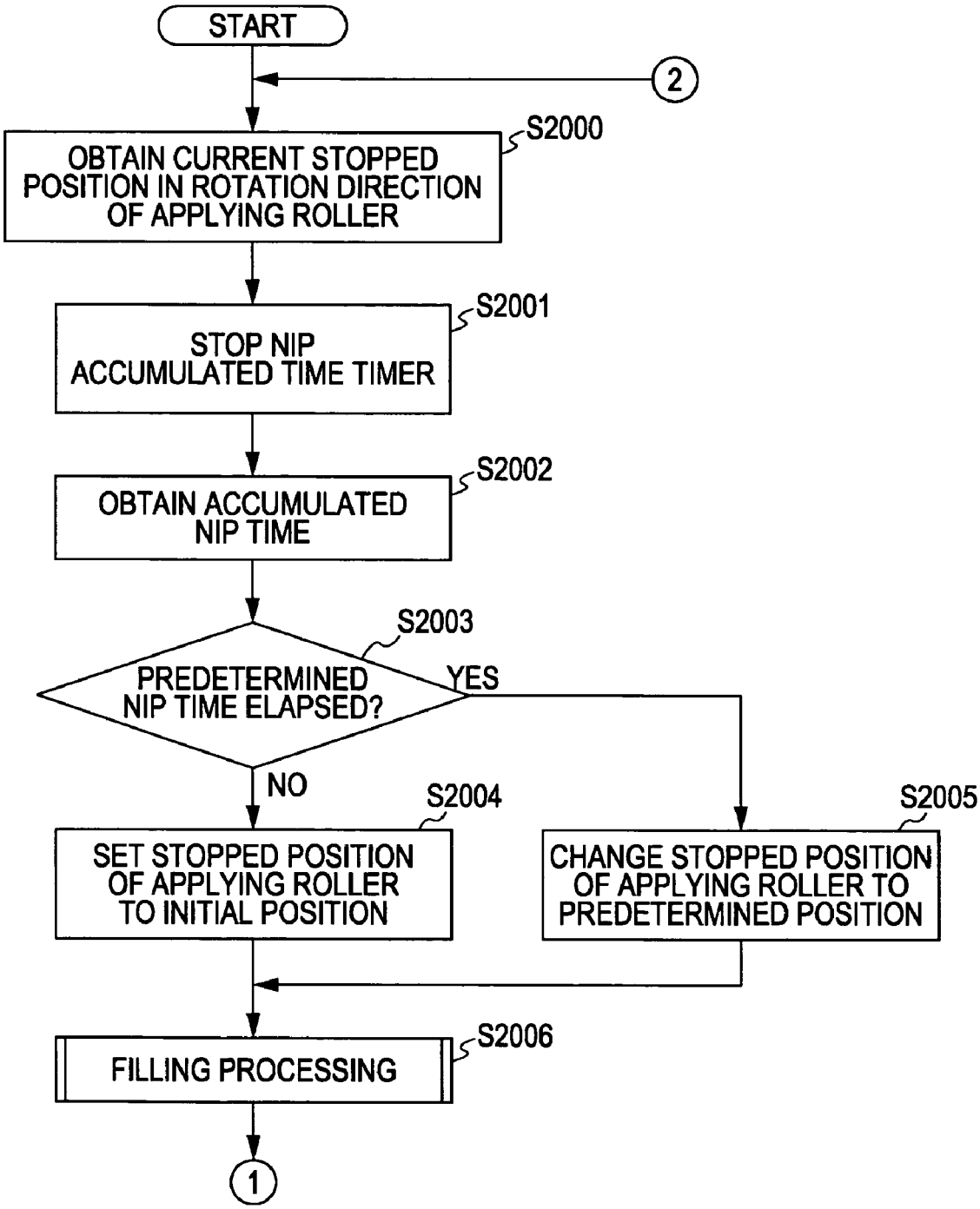
Figure 19B:
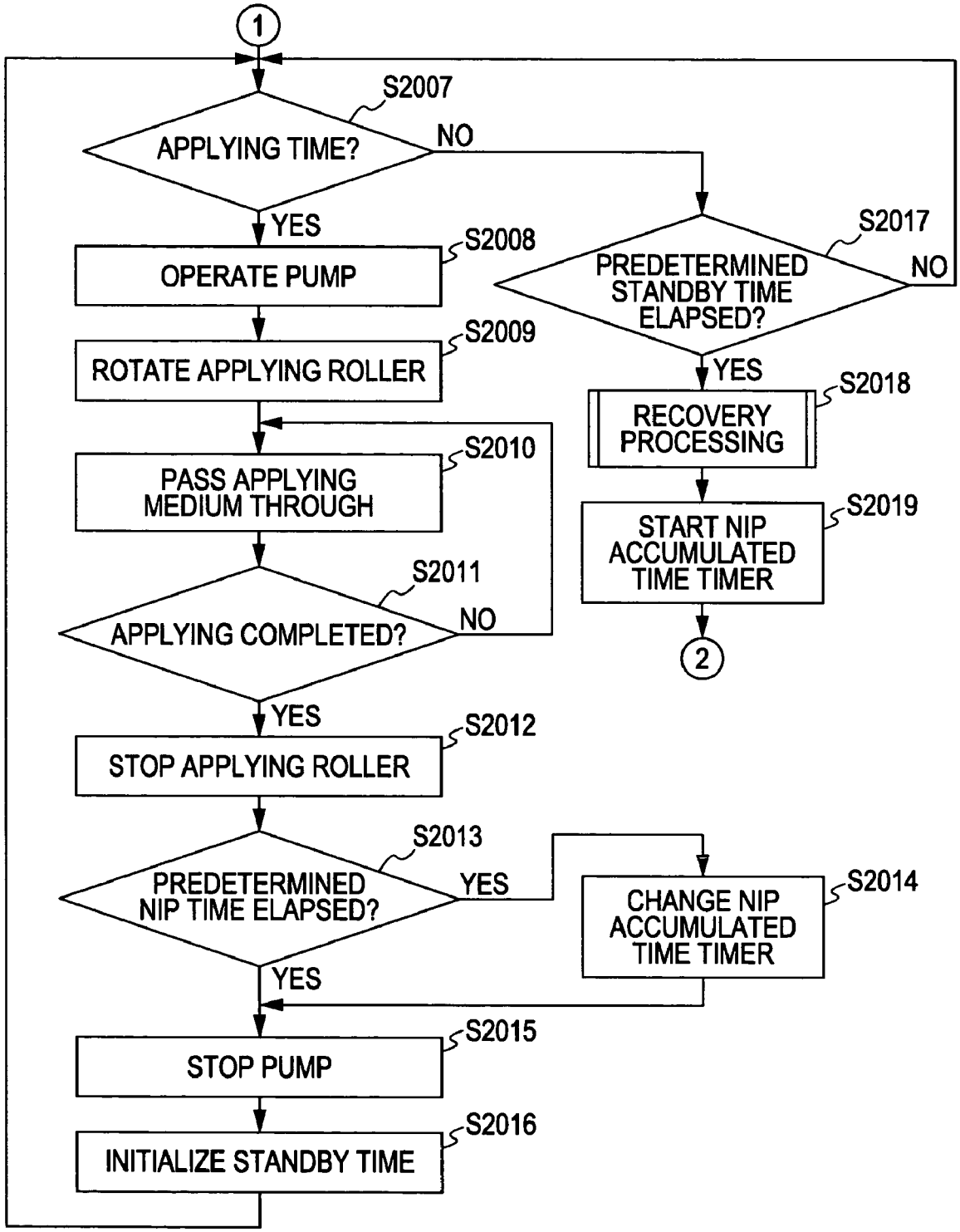

The operations executed in the second embodiment will be described according to the flowchart shown in FIG. 19. First, in step S2000, processing similar to step S1000 of the first embodiment is performed, and the current stopped position of the applying roller 1001 is acquired.

Next, in step S2001, the timer for measuring the nip cumulative time is stopped, and the nip cumulative time measured by the timer unit is acquired in step S2002. If the nip cumulative time acquired in step S2002 is more than the predetermined time (step S2003), in step S2005 the stopping position is changed with the processes similar to the step S1001 in the first embodiment. Also, if the nip cumulative time is less than the predetermined time (step S2003), the current stopping position is set as the stopping position of after the applying operation (step S2004).

Next the flow proceeds to step S2006. Step S2006 is a process similar to step S1002 in the first embodiment. Also, the processes in steps S2007 through 2012 are also the same as steps S1003 through S1008 in the first embodiment, and accordingly description thereof will be omitted.

After stopping the applying roller 1001 in step S2012 in the ending step, whether or not the nip cumulative time is more than the predetermined time is determined in step S2013. Thus, in the case that the nip cumulative time is more than the predetermined time, the timer for nip cumulative time is reset to zero. By resetting this timer to zero, the applying roller 1001 having been stopped at the changed stopping position can be recognized. Further, the nip cumulative timer being reset, along with the stopping position of the applying roller 1001 being changed from the prior stopping position, can be confirmed (step S2014).

Next the process shifts to steps S2015 and S2016, but the processes therein are the same as the processes in steps S1009 and S1010 in the first embodiment, and so the description thereof will be omitted.

After this, the flow proceeds to step S2007, and if an applying start instruction is inputted, the operation in steps S2007 through S2016 are repeated, and if the applying start instruction is not inputted, the process shifts to a waiting state for the applying start instruction. Steps S2017 and S2018 are also similar to steps S1011 and S1012, and so the description thereof will be omitted.

Lastly the flow proceeds to step S2019, the timer which manages the nip cumulative time restarts for the purpose of continuously measuring the currently set nip cumulative time.

As described above, with the second embodiment, as long as the cumulative time of the stopped time of the applying roller 1001 does not surpass the predetermined time, the stopped position of the applying roller 1001 does not change, and the applying roller 1001 is stopped in the same position. Thus, even if starting and stopping of the applying operation is repeated in a short time, stopping at the position on which the applying roller 1001 previously has been stopped for a long period, or nearby thereof, can be avoided. Also, the predetermined time which is the determination standard in step S2013 is set to a time so that the distortion of the applying roller 1001 does not become a problem for applying the liquid to the medium. If the material of the applying roller is silicone rubber, approximately 150 hours is appropriate.

Other Embodiments

With the above-described embodiments, the stopping position is controlled so as to be a position shifted a predetermined amount so that the abutting position of the upper edge 2010 or lower edge 2011 of the abutting member 2009 of the liquid holding member 2001 at the applying surface of the applying roller 1001 does not become the same position repeatedly. However, the shifting amount of the stopped position can be considered not only the abutting position with the liquid holding member 2001 and the applying roller 1001, but also the abutting position of the applying roller 1001 and the counter roller 1002.

Also, the relative position relationships of the applying surface on the applying roller 1001 and the liquid holding member 2001 in the rotation direction can be managed with a count value of a pulse number output from a rotary encoder according to the rotation angle of the application roller. Also, if the drive source is a stepping motor, the relationships can also be managed with the number of steps of the motor.

Also with the previous embodiments, the stopping position for each stopping time is set in advance of stopping, so that the applying member and the liquid holding member do not constantly stop at the same position. However, setting the stopping position of the liquid applying member can be performed immediately following the liquid applying member being stopped. In other words, directly following the liquid applying member stopping, whether or not the current stopping position is at the same position as the prior stopping position is determined, and if the stopping position is the same as the prior stopping position, the liquid applying member can be set to stop at a position differing from that of the prior time. Also, the stopped position history for multiple times can be stored using a nonvolatile memory or the like, and whether or not the current stopping position immediately following stopping is the same stopping position as that stored in the stopping history is determined, and if the position is the same, the stopping position is set to be a position other than that in the stopping history.

The above-mentioned embodiments assume a configuration having a liquid holding member in a fixed position in the rotation direction of the applying member, and therefore the abutting position of the liquid holding member and the applying member can be managed by managing only the stopping position of the applying member. However, the abutting position of the applying member and the liquid holding member can be changed by shifting the liquid holding member toward the rotation direction of the applying member. In this case, the abutting position of the liquid holding member and the applying member needs to be managed based on the position information of both the liquid holding member and the applying member.

Embodiment of an Ink Jet Printing Device

Figure 20:
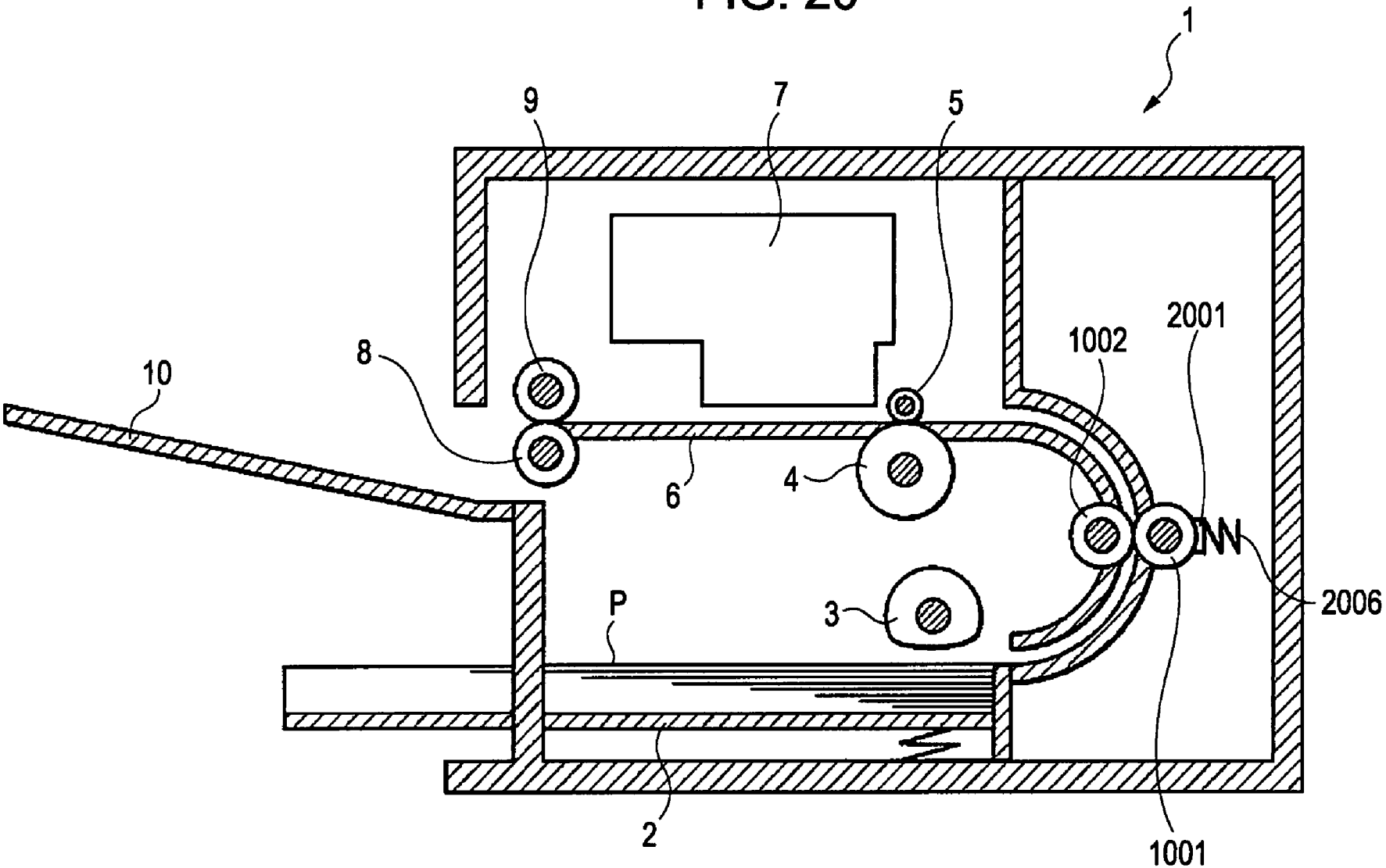
FIG. 20 is a vertical side view showing the overall configuration of an ink jet printing apparatus according to the embodiment of the present invention.

FIG. 20 is a diagram showing the overall configuration of an ink jet printing apparatus 1 including an applying mechanism having almost the same configuration as that of the above liquid applying apparatus.

The ink jet printing apparatus 1 is provided with a feeding tray 2 on which a plurality of print media P are stacked. A semicircular separating roller 3 separates each print medium P from the others stack on the feeding tray and then feeds it to a conveying path. The applying roller 1001 and the counter roller 1002 are arranged in the conveying path; the applying roller 1001 and the counter roller 1002 constitute a liquid applying unit of the liquid applying mechanism. The print medium P fed by the feeding tray 2 is then fed to the point between the rollers 1001 and 1002. The applying roller 1001 is rotated clockwise in FIG. 20 by the rotation of a roller driving motor. The applying roller 1001 applies the application liquid to a print surface of the print medium P while conveying the print medium P. The print medium P to which the application liquid has been applied is fed to a point between a conveying roller 4 and a pinch roller 5. Then, the conveying roller 4 is rotated counter-clockwise in the figure to convey the print medium P on a platen 6. The print medium P then moves to a position opposite to a print head 7 constituting a printing unit. The print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this image forming operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

As this ink jet printing apparatus, what is called a full line type can be constructed in which an elongate print head having nozzles from which inks are ejected and which are disposed over the maximum width of the print medium is used to perform a printing operation.

The application liquid used in the present embodiment is a treatment liquid that facilitates the coagulation of pigments when inks composed of the pigments as color materials are used for printing.

In the present embodiment, the treatment liquid is used as an application liquid to react with the pigments, which are the color materials of the inks ejected to the print medium to which the treatment liquid has been applied. This facilitates the coagulation of the pigments. This encapsulation improves the printing density. Moreover, it is possible to suppress or prevent bleeding. The application liquid used in the ink jet printing apparatus is not limited to the above example.

Figure 21:
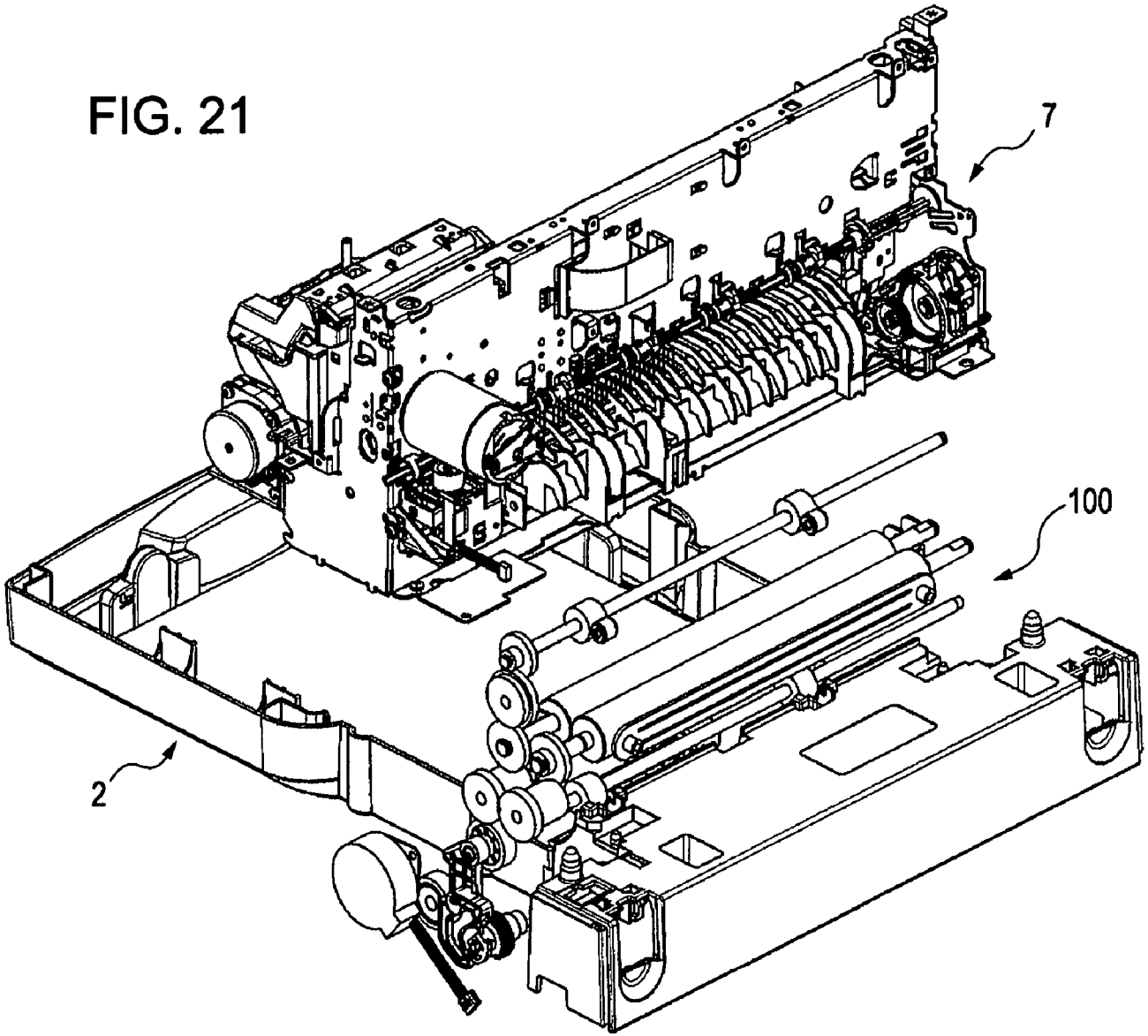
FIG. 21 is a perspective view showing the primary portions of the ink jet printing apparatus shown in FIG. 20.

FIG. 21 is a perspective view showing an essential part of the above ink jet printing apparatus. As shown in the figure, an applying mechanism 100 is provided above one end of the feeding tray 2. A printing mechanism including the print head 7 and the like is provided above the applying mechanism 100 and above a central portion of the feeding tray 2.

Figure 22:
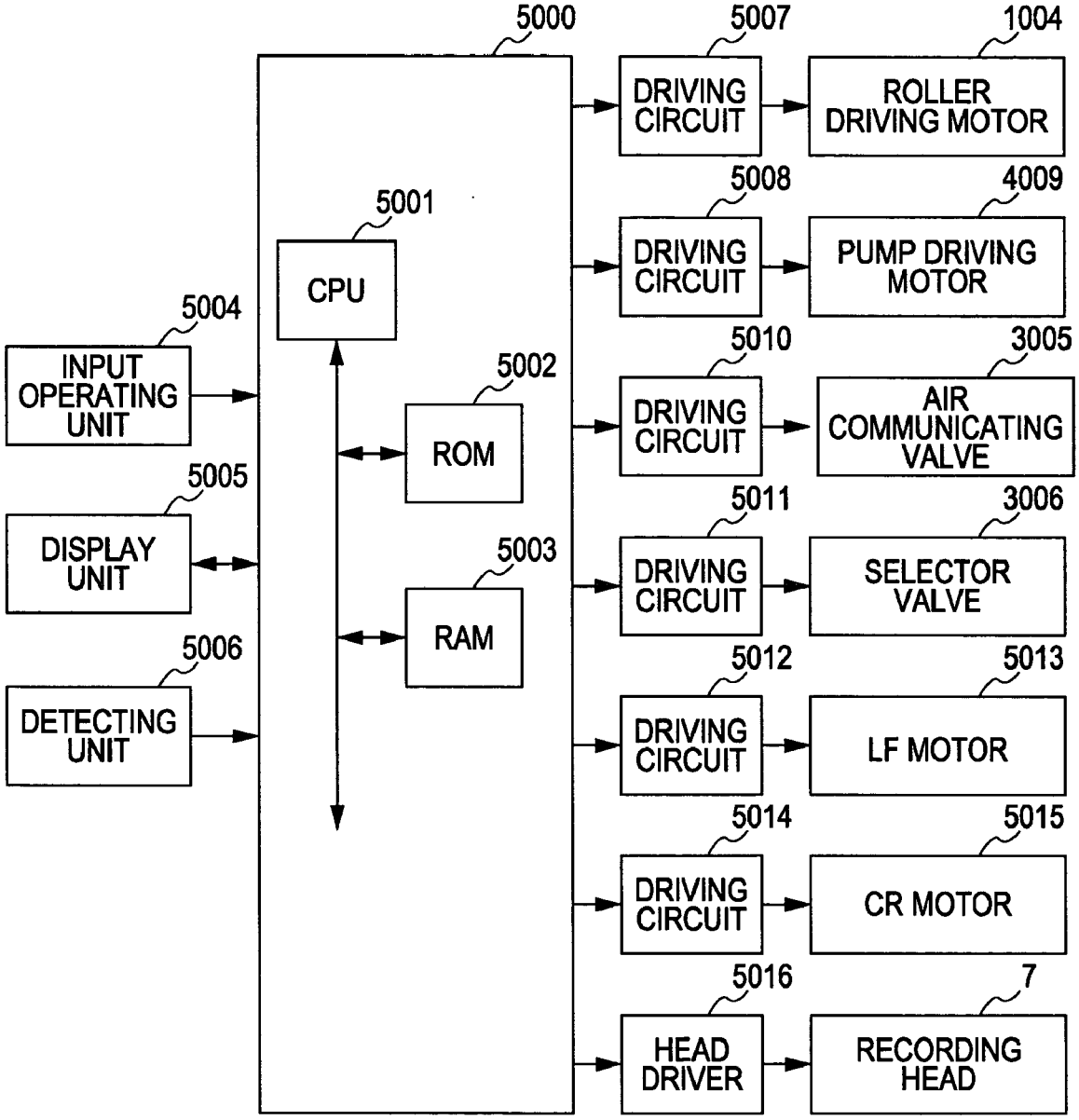
FIG. 22 is a block diagram showing the overall configuration of a control system of the ink jet printing apparatus shown in FIG. 20.

FIG. 22 is a block diagram showing the overall configuration of a control system for the above ink jet printing apparatus. In this figure, the roller driving mechanism 1004, the pump driving motor 4009, and the actuator 3005 for the air communicating valve, all of which are elements of the liquid applying mechanism, are similar to those described for the liquid applying apparatus.

In accordance with a program of a process procedure described below in FIG. 23, a CPU 5001 controls the driving of the elements of the applying mechanism. The CPU 5001 also controls the driving of an LF motor 5013, a CR motor 5015, and the print head 7 which relate to the printing mechanism, via driving circuits 5012, 5014, and 5016. That is, driving by the LF motor 5013 rotates the conveying roller 4. Driving by the CR motor moves a carriage on which the print head 7 is mounted. Moreover, the CPU 5001 performs control such that inks are ejected through the nozzles in the print head.

Figure 23:
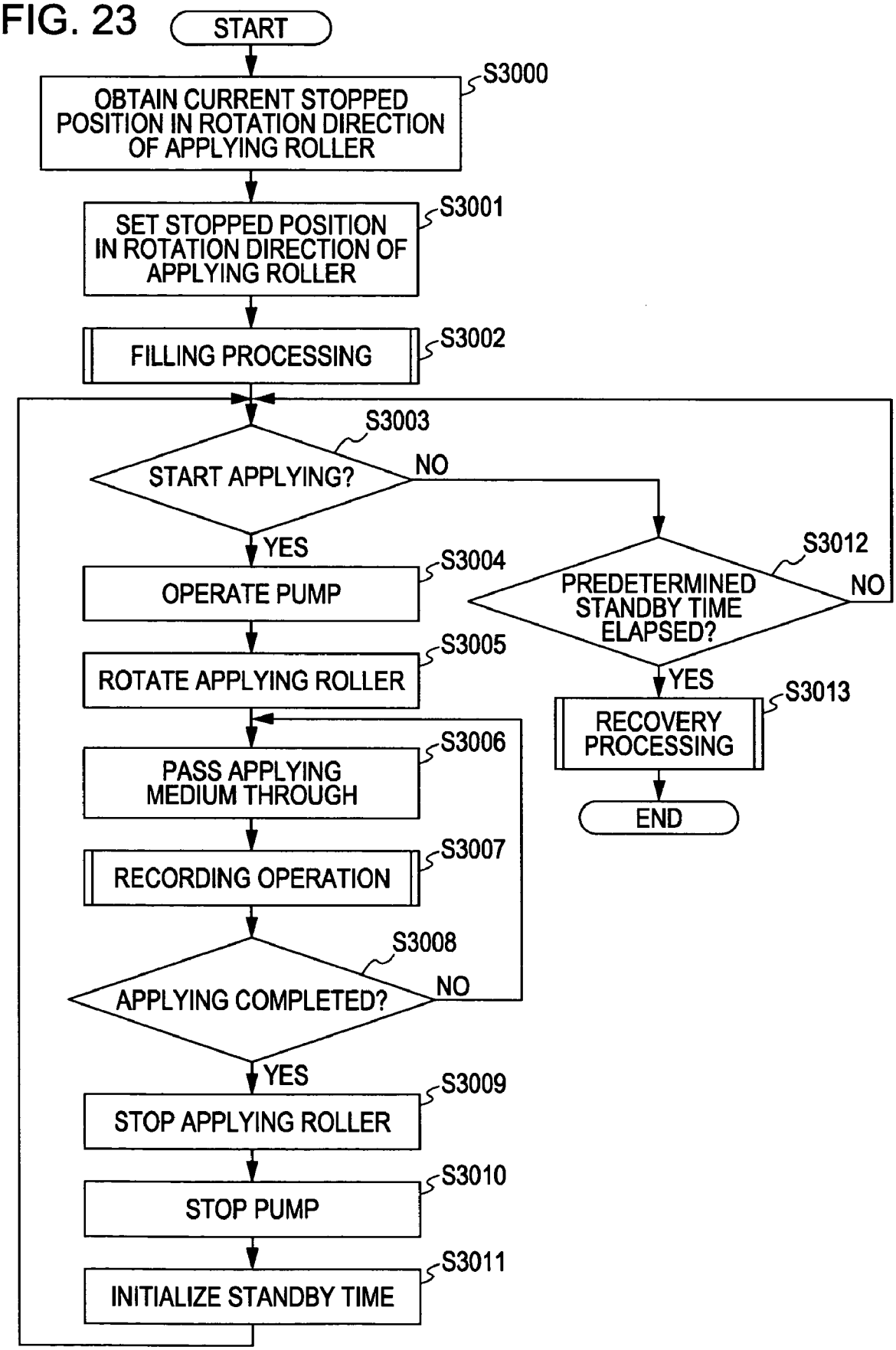
FIG. 23 is a flowchart showing the sequences of a liquid applying operation and a printing operation executed with the ink jet printing apparatus shown in FIG. 20.

FIG. 23 is a flowchart showing the procedure of liquid application and an accompanying printing operation in the ink jet printing apparatus according to the present embodiment. In the figure, the processing during steps S3000 through S3002, excluding steps S3003, S3007, and S3008, is similar to that during steps S1000 through S1012, excluding steps S1003 and S1007, all the steps being shown in FIG. 13.

As shown in FIG. 23, in the present embodiment, a print start instruction is given (step S3003). Then, a series of liquid applying operations such as pump activation are performed (steps S3004 through S3006). After this, liquid is applied to the portions of the printing medium on which liquid application is necessary.

After this applying step, a printing operation is performed on a print medium having the application liquid applied to desired parts of the medium (step S3007). That is, the print head 7 is scanned over the print medium P conveyed by the conveying roller 4 by a predetermined amount at a time. During the scan, inks are ejected from the nozzles in accordance with print data so as to adhere to the print medium to form dots. The adhering inks react with the application liquid, thus improving the concentration and preventing bleeding. The conveyance of the print medium and the scanning of the print head are repeated to print the print medium P. The finished print medium is discharged onto the sheet discharging tray 10. When the printing is determined to be finished in step S3008, the processing of step S3009 are thereafter is performed, and the present process is ended.

In the present embodiment, as the liquid is applied to the print medium, printing is sequentially executed on parts of the print medium to which the liquid has already been applied. That is, the conveying path from the conveying roller to the print head is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one print medium has been completely applied the application liquid to as described in Japanese Patent Laid-Open No. 2002-96452.

The printing apparatus of the present invention can have a liquid application mechanism by which the degree of whiteness of the medium can be improved by using a liquid containing a fluorescent whitening agent as an application liquid. Also, a liquid containing components to restrain a curl (phenomenon in which a medium becomes curve shape) of the application medium may be used. The printing means after the liquid application is not limited to the ink jet printing system. Effects can be produced using a printing system such as a thermal transfer system or an electro-photographic system.

In a silver salt-based printing apparatus, a photosensitive agent as the application liquid may be applied before printing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-168568 filed Jun. 8, 2005, which is hereby incorporated by reference herein in its entirety.

What is claimed is:

1. A liquid applying apparatus comprising:

a liquid applying unit including:

an applying member having an applying surface with variable elasticity and adapted to apply a liquid to a medium; and a liquid holding member abutting against the applying surface of the applying member to define a liquid holding space to hold the liquid, wherein the liquid applying unit applies the liquid held in the liquid holding space to the medium through the applying surface by rotating the applying surface of the applying member; and an abutting position setting unit configured to set an abutting position after a completed applying operation according to an abutting position before starting the applying operation, so that the abutting position of the applying member and the liquid holding member after the completed applying operation differs from the abutting position thereof before starting the applying operation.

2. The liquid applying apparatus according to claim 1, wherein the abutting position setting unit causes the abutting position after the completed applying operation to differ from the abutting position after a previous completed applying operation.

3. The liquid applying apparatus according to claim 1, further comprising a time measuring unit configured to measure a stopped time of the applying surface, wherein the abutting position setting unit causes the abutting position after the completed applying operation to differ from the abutting position before starting the applying operation, when the stopped time of the applying surface before starting the applying operation is greater than a predetermined time.

4. The liquid applying apparatus according to claim 1, further comprising a storing unit storing information regarding the abutting position at the time when the applying operation is stopped, wherein the abutting position setting unit acquires information regarding the abutting position before starting the applying operation from the storing unit, and sets the abutting position after the completed applying operation according to the acquired information, and stores the information regarding the currently set abutting position in the storing unit.

5. The liquid applying apparatus according to claim 1, wherein the abutting position setting unit stops the applying surface after the completed applying operation, so that the abutting position after the completed applying operation is at a position separated from the abutting position before starting the applying operation, by a predetermined distance.

6. A control method for a liquid applying apparatus, comprising:

preparing an applying member having an applying surface with variable elasticity and adapted to apply a liquid to a medium and a liquid holding member that abuts against the applying surface of the applying member to define a liquid holding space to hold the liquid;

applying the liquid held in the liquid holding space to the medium through the applying surface by rotating the applying surface of the applying member; and setting an abutting position of the applying member and the liquid holding member after completing the applying the liquid to differ from the abutting position of the applying member and the liquid holding member before starting the applying the liquid.

7. A printing apparatus for printing on a printing medium, comprising:

a conveying unit configured to convey the printing medium along a conveying path;

a liquid applying unit including:

an applying member having an applying surface with variable elasticity and adapted to apply a liquid; and a liquid holding member abutting against the applying surface of the applying member to define a liquid holding space to hold the liquid, wherein the liquid applying unit applies the liquid to the printing medium, which is conveyed along the conveying path, through the applying surface by rotating the applying surface of the applying member;

a printing unit configured to print to the print medium on which the liquid is applied by the liquid applying unit; and an abutting position setting unit configured to set an abutting position after a completed applying operation according to an abutting position before starting the applying operation, so that the abutting position of the applying member and the liquid holding member after the completed applying operation differs from the abutting position thereof before starting the applying operation.

8. A printing apparatus for printing on a printing medium using ink including a color material and a liquid for coagulating the color material in the ink, comprising:

a liquid applying unit including:

an applying member having an applying surface with variable elasticity and adapted to apply the liquid to the printing medium; and a liquid holding member that abuts against the applying surface of the applying member to form a liquid holding space to hold the liquid, wherein the liquid applying unit applies the liquid to the printing medium through the applying surface by rotating the applying surface of the applying member;

ink jet head for discharging ink to the printing medium on which the liquid is applied by the liquid applying unit; and abutting position setting means for setting the abutting position of the applying member and the liquid holding member after the completed applying operation to differ from the abutting position thereof before starting the applying operation.

* * * * *